US007886846B2

(12) United States Patent
Pires

(10) Patent No.: US 7,886,846 B2
(45) Date of Patent: Feb. 15, 2011

(54) APPARATUS AND SYSTEM AND METHOD FOR DOWN THE HOLE CAROUSEL DRILLING

(75) Inventor: Oswaldo M. Pires, McKinney, TX (US)

(73) Assignee: Terex Corporation, Westport, CT (US)

( * ) Notice: Subject to any disclaimer, the term of this patent is extended or adjusted under 35 U.S.C. 154(b) by 51 days.

(21) Appl. No.: 12/290,579

(22) Filed: Oct. 31, 2008

(65) Prior Publication Data

US 2010/0108388 A1 May 6, 2010

(51) Int. Cl.
*E21B 19/00* (2006.01)
*E21B 19/14* (2006.01)

(52) U.S. Cl. ..... 175/52; 175/85; 414/22.66

(58) Field of Classification Search ..... 175/52, 175/85; 166/77.1, 77.51, 85.1; 414/22.6, 414/22.66, 22.63, 22.65, 22.67, 745.4
See application file for complete search history.

(56) References Cited

U.S. PATENT DOCUMENTS 3,336,991 A * 8/1967 Klem et al. ..... 175/85
3,913,753 A * 10/1975 Swartz et al. ..... 414/22.66
3,985,189 A * 10/1976 Jahnke et al. ..... 175/52
4,082,017 A 4/1978 Eckel
4,128,135 A 12/1978 Mitchhart et al.
4,174,011 A 11/1979 Zaremba
4,194,419 A 3/1980 Mitchhart et al.
4,278,135 A 7/1981 Curington
5,067,262 A 11/1991 Stiffler et al.
5,143,163 A 9/1992 Stiffler et al.
5,398,772 A 3/1995 Edlund
5,413,186 A 5/1995 Campbell
5,465,798 A 11/1995 Edlund et al.
5,537,900 A 7/1996 Schaar
5,575,344 A 11/1996 Wireman

* cited by examiner

*Primary Examiner*—Daniel P Stephenson
*Assistant Examiner*—Michael Wills, III
(74) *Attorney, Agent, or Firm*—Brooks Kushman P.C.

(57) ABSTRACT

A method and apparatus for carousel drilling, which includes a drill tower having a rotatable drive motor at the top, and a carousel pivotably attached with respect to the drill tower and capable of supporting four elongated drilling devices, at least certain of which are drill extenders capable of attachment to, and detachment from, a drilling tool. A retainer plate is located at the upper end portion of the carousel to receive and retain the drilling devices in a generally vertical orientation when the drill tower and the carousel are raised to a generally vertical orientation for operative drilling. A primary breaker plate is provided for individually receiving and engaging each drilling device at the lower end portion of the carousel. A secondary breaker plate is located above the primary breaker plate for individually receiving the four drilling devices.

17 Claims, 22 Drawing Sheets

APPARATUS AND SYSTEM AND METHOD FOR DOWN THE HOLE CAROUSEL DRILLING

BACKGROUND OF THE INVENTION

1. Field of the Invention

The present invention relates to an apparatus and system and method for down the hole carousel drilling into grounds consisting of various types of materials, i.e., soft and hard, for recovery of various minerals and the like. The present invention is applicable to all types of carousel drilling, including oil drilling and the like.

2. Description of the Related Art

In carousel drilling a mast consisting of vertical drill tower is comprised of a well-known combination of steel beams and reinforcing plates welded or bolted together as shown. The drill tower is attached in the well-known manner to an operator's cab in which the operator of the drill rig has access to various well-known remote controlled devices for operating the rig as in a manner well known in the industry.

The drill tower is equipped with a drill carousel which is structured and adapted to support a combination of drill extenders for selectively adding drill extenders to the drilling mechanism as required for continuous drilling into the ground, once the previous extender has been completely advanced into the drill hole. In the prior art, the carousel drilling structure generally supported four of such drill extenders of equal length, to enable a drilling operation to continue progressing into the drill hole by making readily available a continuous series of drill extenders for attachment to each other as they are driven progressively into the drill hole. Since the drill extenders are generally of hollow steel construction and about 25 or 30 feet in length, shifting such tools from place to place can be somewhat difficult.

For example, the drilling operation may begin with a combination comprised of a drill extender having a particular type of drill tool attached to the lower end portion. The drill tool may generally be a tricone drill tool comprised of a tricone drill bit and stabilizer for drilling into relatively soft ground materials, or a hammer drill tool comprised of a hammer drill bit and barrel for drilling into relatively hard materials. These types of drilling are well known.

The drilling operation may begin, for example, with a tricone drill tool attached to a drill extender and arranged to be continuously rotated by a rotary drive motor located at the top of a drill tower. In general, as a practical matter, the combined length of the drill extenders and the drill tools is either thirty feet or thirty-five feet, depending upon the particular drill rig which is used. Drill rigs of the other dimensions are contemplated and clearly applicable to the present invention.

When the drilling operation begins, a drill tool such as a tricone drill tool is positioned in the drill hole and arranged to be progressively rotated by the rotary drive motor and connecting devices located at the top of the drill tower, so that the rotary drive motor progressively advances the drill tool into the drill hole until the combined drill tool and drill extender are almost completely advanced into the drill hole, leaving only the top portion of the drill extender exposed. Thereafter the carousel is pivoted into position from the rest position for attachment of a second drill extender to the upper end of the previous drill extender which has already been almost completely advanced into the drill hole. The carousel is then pivoted about its own axis, which extends through the carousel shaft, to a position where the next drill extender is located precisely over the previous drill extender in the drill hole. Then, the new drill extender is readily threadedly attached to the rotary drive at the upper end, and to the previous drill extender in the drill hole at the lower end, utilizing a primary breaker plate at the lower end of the new drill extender, which acts as an open-end wrench on flat surfaces located on the drill extender to restrain the new drill extender from rotating. A sliding fork wrench located adjacent the upper end portion of the previous drill extender in the drill hole acts as an open-end wrench on the upper flat surfaces of the previous drill extender. When needed, a Hobo wrench is used to grip the drill extender, and occasionally the drill tools, to assist in the changeover. A Hobo wrench is a large wrench having exposed gripping surfaces, which functions somewhat similar to a large pipe wrench.

After the attachment is complete, the carousel is rotated out of the way, once again, to the rest position shown in FIG. 1 and the drilling operation continues with the rotary drive motor advancing downwardly and applying force to the entire combination of drill tool and drill extenders until the newly attached drill extender is advanced completely into the drill hole. If further drilling is required, the process of adding drill extenders is continued until all four drill extenders originally situated in the carousel are utilized and in the drill hole.

As noted, in the prior art, the carousel was made to accommodate only drill extenders, and in particular, four of such drill extenders for successively and quickly attaching each one to a previous drill extender to continue advancing the drill tool into the drill hole. However, in the event there was a need to changeover from one type of drill tool, such as a tricone drill tool, to another type of drill tool, such as a hammer drill tool, the changeover was extremely time consuming and required a substantial amount of manpower to accomplish, due in part by the absence of a device in the carousel which is available to engage the drill extender at a relatively higher level to facilitate the threading and unthreading operations once it is attached to a drill tool. In particular, attachment of the drill extender to a drill tool effectively raised to a higher level, the flat surfaces normally provided on the drill extender for engagement by a primary breaker plate which was provided in prior art drilling devices for such tasks. This primary breaker plate was located at a lower level of the carousel in such prior art drilling devices, as it is in the present invention, as well. However, the prior art carousels did not include a secondary breaker plate at a level above the primary breaker plate to accommodate such situations. Therefore, carousels of the prior art were not equipped to readily advance pre-assembled drill extenders and drill tools into the drilling operation.

In such instances, the entire string of drill extenders already in the drill hole had to be successively withdrawn from the drill hole and successively stored in the carousel by a procedure which was essentially the reverse of the original drilling procedure. The prior art systems did not include a secondary breaker plate to restrain the drill extender to assist in threadedly attaching and detaching the drill extender and drill tool assemblies in an automatic fashion, as with the drill extenders alone.

After all of the drill extenders were removed from the drill hole, the actual drill tool in the drill hole was last to be removed for replacement with an alternative type of drill tool, i.e., from a tricone drill tool to a hammer drill tool, or vice a versa. This procedure required utilizing heavy equipment and substantial manpower to remove the drill tool from the drill hole and replace it with a new drill tool. Thereafter, the carousel was again pivoted toward the drill hole to position a drill extender over the drill hole to allow attachment of the drill extender to the new drill tool now installed in the drill hole.

As will be readily understood, this process was extremely time consuming, as well as requiring a substantial amount of mechanical and human effort. The present invention is directed toward a quick changeover technique, whereby the carousel is adapted to store several types of drill tools in combination with several drill extenders, so that the changeover from one type of drill tool to another is rapid and essentially equivalent to adding a single drill extender to a drill extender already located in the drill hole, a procedure which requires a minimal amount of time and human and machine effort.

SUMMARY OF THE INVENTION

An apparatus for carousel drilling is disclosed, which comprises, a drill tower including a rotatable drive motor, a carousel pivotably attached with respect to the drill tower and capable of supporting a plurality of elongated drilling devices, at least certain of the drilling devices being drill extenders capable of attachment to, and detachment from, a drilling tool. Means for supporting the position of each of the elongated drilling devices is located at the upper end portion of the carousel, to retain the drilling devices in a generally vertical orientation when the drill tower and the carousel are raised to a generally vertical orientation for operative drilling.

First means is provided on the carousel for individually engaging at least certain of the drilling devices at the lower end portion thereof in a manner to prevent rotation of the drilling devices for purposes of attachment to, or detachment from, other such drilling devices. Second means is provided on the carousel for individually engaging at least the remaining drilling devices, and located above the first drilling device engaging means, the second engaging means being capable of individually engaging and preventing rotation of each the drilling devices at a location above the drilling device engagement location of the first engaging means.

At least two of the elongated drilling devices are standard sized drill extenders. At least one of the elongated drilling devices is a standard size drill extender having a hammer drill tool attached at the lower end thereof. At least one of the drilling devices is a standard size drill extender having a tricone drill tool attached at the lower end thereof.

The carousel is pivotably attached to the drill tower. The means for supporting the position of each drill extender at the upper end portion thereof is a retainer plate having a plurality of generally circular cutout openings for individual reception of each drill extender. The first means for individually engaging at least two of the drilling devices at the lower end portion of the carousel is a primary breaker plate having at least two generally circular cutout openings for nestled reception of drilling devices, and at least two wrench-like cutout openings having opposed straight sides for engagement with corresponding flat surfaces on at least two of the drilling devices to restrain the drilling devices from rotation when being attached to, or detached from, the rotating drive motor or other such drilling devices.

The second means for individually engaging each of the drilling devices is a secondary breaker plate having at least two generally circular cutout openings at locations corresponding to the wrench-like cutout openings of the primary breaker plate having opposed flat surfaces, and at least two cutout openings having opposed straight sides in positions corresponding respectively to the positions of the generally circular openings in the primary breaker plate, such that when a drilling device is positioned in one of the generally circular openings of one of the primary and secondary breaker plates, the drilling device is also positioned in a flat sided wrench-like cutout opening of the other breaker plate.

An apparatus for carousel drilling is disclosed, which comprises, a drill tower including a rotatable drive motor, a carousel pivotably attached with respect to the drill tower and capable of supporting a plurality of elongated drilling devices, at least two of the drilling devices being drill extenders capable of attachment to, and detachment from, a drilling tool, and at least two of the drilling devices comprised of drill extenders, each having a drill tool attached to the lower end thereof, and each of the drilling devices being substantially equal in length. An upper retainer plate is mounted on the carousel for supporting the position of each of the elongated drilling devices located at the upper end portion of the carousel, the retainer plate including four generally circular cutout openings for nestled reception of each of the drilling device, to retain the drilling devices in a generally vertical orientation when the drill tower and the carousel are raised to a generally vertical orientation for operative drilling.

A primary breaker plate has at least two wrench-like cutout openings for receiving and engaging two of the drilling devices at the lower end portion thereof in a manner to prevent rotation of said drilling devices for purposes of attachment to, or detachment from, other such drilling devices.

A secondary breaker plate has at least two cutout openings for receiving and engaging the remaining two of the drilling devices and located above the first drilling device engaging means, the secondary breaker plate having wrench-like cutout openings capable of individually engaging and preventing rotation of each the drilling devices at a location above the engagement location of the primary breaker plate.

A method of downhole drilling is also disclosed.

BRIEF DESCRIPTION OF THE DRAWINGS

Preferred embodiments of the invention will be described here below with reference to the drawings, wherein.

DETAILED DESCRIPTION OF THE PREFERRED EMBODIMENTS

In the description which follows, the expression, "drilling device" is intended to mean either a drill extender per se, or a combination drill extender plus drill tool, such as a tricone drill tool or a hammer drill tool. A tricone drill tool is comprised of a tricone drill bit plus a well known tricone drill stabilizer. Similarly, a hammer drill tool is comprised of a hammer drill bit plus a well known drill bit plus a well known hammer drill barrel.

Figure 7:
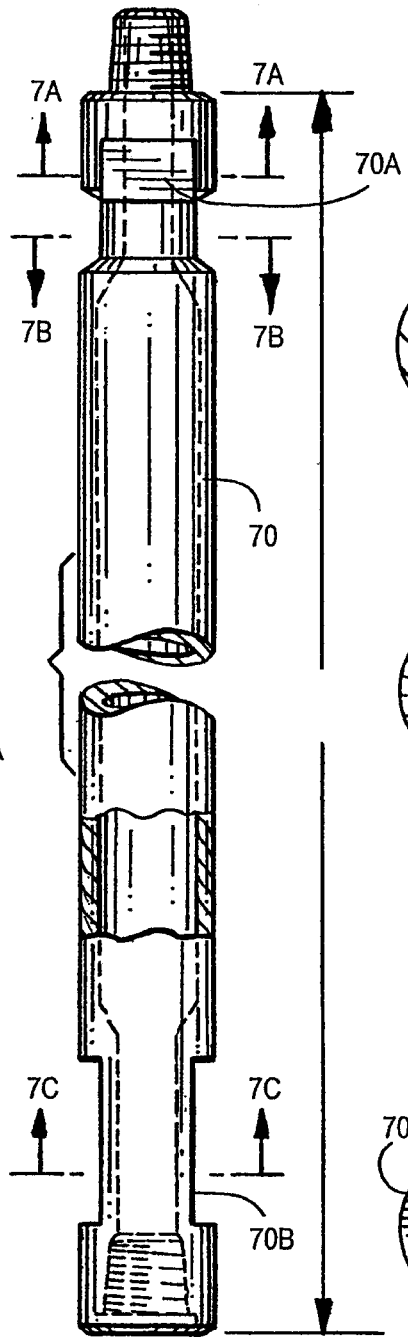
FIG. 7 is a vertical elevational view of a typical drill extender used for drilling with the present apparatus, as well as in prior art drilling systems.

Additionally, for convenience of illustration, all of the views of a drill extender do not show all of the flat surfaces and neck down section as shown in detail in FIG. 7. However, it should be understood that in all of the views of the present application which show a drill extender, the details shown in FIG. 7 are incorporated therein by reference.

Figure 1:
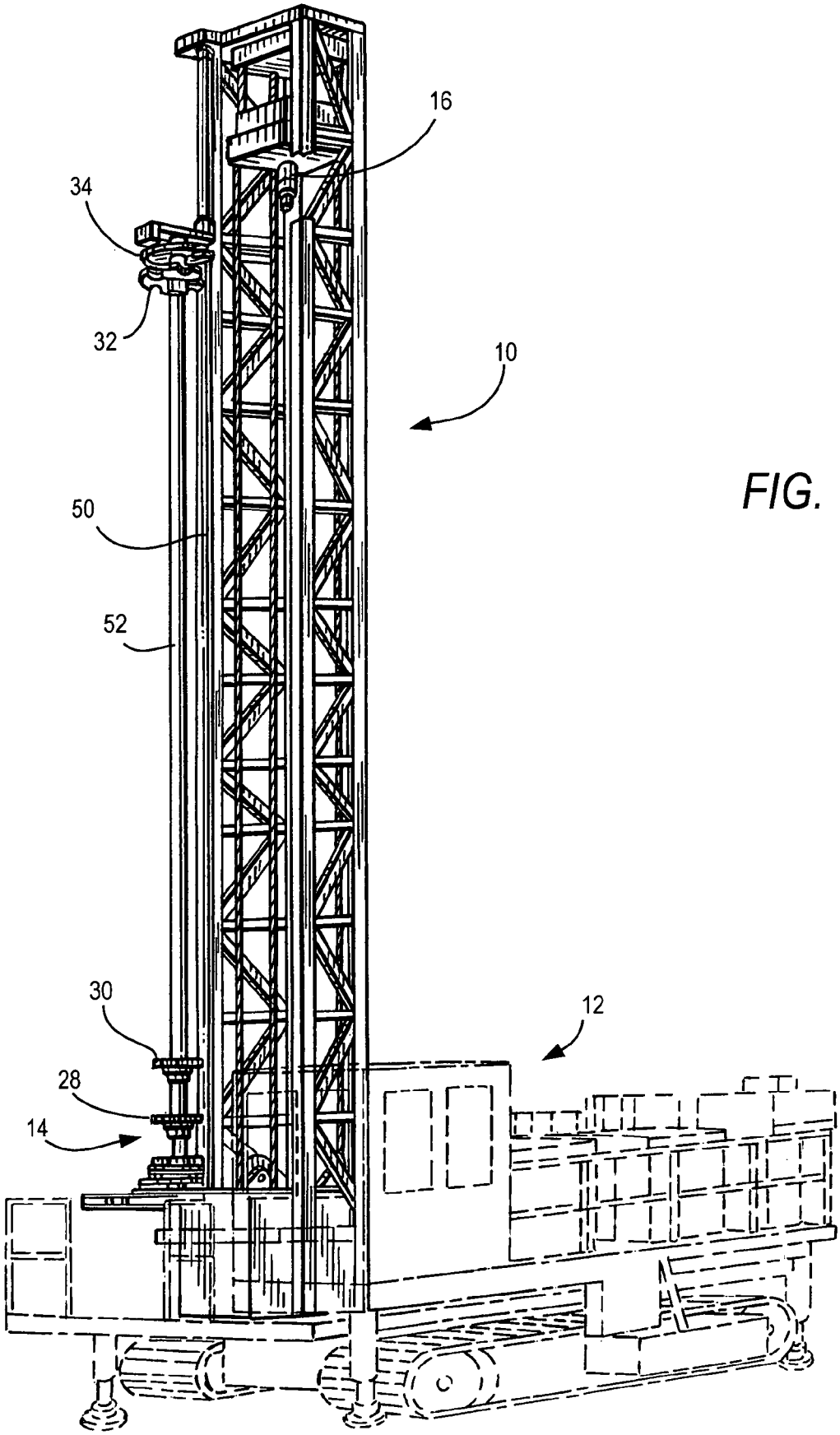
FIG. 1 is an overall view showing a mast comprised of a drill tower in a vertical position, with the carousel pivoted outwardly to an open position, the bottom portion of the drill rig being shown in phantom lines.

Referring to the drawings, and initially to FIG. 1 there is shown a mast consisting of vertical drill tower 10 which is comprised of a well known combination of steel beams and reinforcing plates welded or bolted together as shown. The drill tower 10 is attached in the well known manner to an operator's cab 12 which is shown in dash lines for environmental purposes. The operator's cab 12 includes an inner cabin in which the operator of the drill rig has access to various well known remote controlled devices for operating the rig in a manner known in the industry.

Referring again to FIG. 1, the drill tower 10 is equipped with a carousel 14 which is structured and adapted to support elongated drill extenders, as well as combinations of combined drill extenders and drill tools for selectively adding either drill extenders, or alternative drill tools to the drilling mechanism as required for continuous drilling into the ground. By "drill tool" is meant a combination of a drill bit (i.e., tricone or hammer) and related attachment as noted hereinabove.

Figure 3:
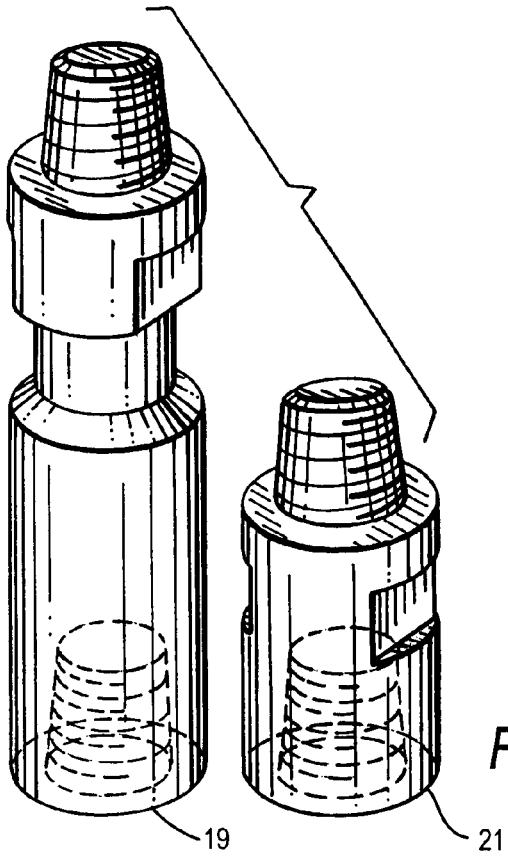
FIG. 3 is a top perspective view of the long and short adaptors used for drilling with the present system.

The present invention adds an adapter 19, 21 shown in FIG. 3, which is dimensioned to supplement the drill tool to bring the combined length of the drill extender and the drill tool to a standard dimension which fits the carousel. In practice, such carousels accept such drill extenders or combination drill extenders and drill tools, thirty and thirty-five feet in length. The invention may also be incorporated into carousels of other dimensions, as well as in carousels for other types of drilling, such as oil and the like.

Therefore, for example, if a tricone drill tool is to be used with a thirty foot carousel, the drill extender will be about twenty five feet in length and the remaining five feet will be taken up in part by the tricone drill tool (i.e., drill bit plus barrel), which sometimes is about three and one-half feet in length. Accordingly, an additional tricone tool adapter about one and one-half feet in length will be required to complete the additional five feet needed to fit the carousel. Similarly, if a hammer drill tool (i.e., hammer drill bit plus barrel) is to be used, the hammer drill bit plus barrel is about sometimes four and one-half feet in length. Therefore the additional five feet required to match the length of the thirty foot carousel will be made up by a hammer drill tool adapter about one-half foot in length. Similar considerations are applicable for use with a thirty-five foot carousel, where the individual drill extenders selected are about thirty feet in length and the drill tools and adapters combined are about thirty-five feet in length, making the entire assembly thirty-five feet in length.

Hammer drill tools are well known. One example of such hammer drill tool is disclosed in commonly assigned U.S. Pat. No. 5,398,772 to Edlund, the disclosure of which is incorporated herein by reference and made a part of this disclosure.

It should be understood that the dimensions stated hereinabove are approximate examples, and can be varied from the stated figures due to variations between devices, as well as differences in the sizes of the devices. The significant aspect of the invention is that the combined length of the drill tool and adapter in the case of either type drill tool, is equal to the difference between the length of the carousel and the length of the next shorter sized drill extender.

For example, the drilling operation may begin with a combination of a drill extender having a particular type of drill tool attached to the lower end portion. The drill tool may generally be a tricone drill tool having a tricone drill bit and stabilizer for drilling into relatively soft ground materials, or a hammer drill tool comprised of a hammer drill bit and barrel for drilling into relatively hard ground materials. The drilling operation may begin, for example, with a tricone drill tool in the drill hole, the drill tool attached to a drill extender and arranged to be continuously rotated by the drilling mechanism as will be described. As noted, the standard combined length of the drill extenders and the drill tools is generally either thirty feet or thirty-five feet to correspond to the length of the carousel of the particular drill rig which is used.

When the drilling operation begins, a drill tool such as a tricone drill tool is positioned in the drill hole and arranged to be progressively rotated by the rotary drive motor 16 and connecting devices located at the top of the drill tower 10, so that the rotary drive motor progressively advances the drilling tool into the drill hole until the combined drill tool and drill extender are advanced substantially entirely within the drill hole, leaving only the top portion of the drill extender having flat surfaces exposed for engagement by a sliding fork wrench 18 as shown in FIGS. 9-15.

Figure 9:
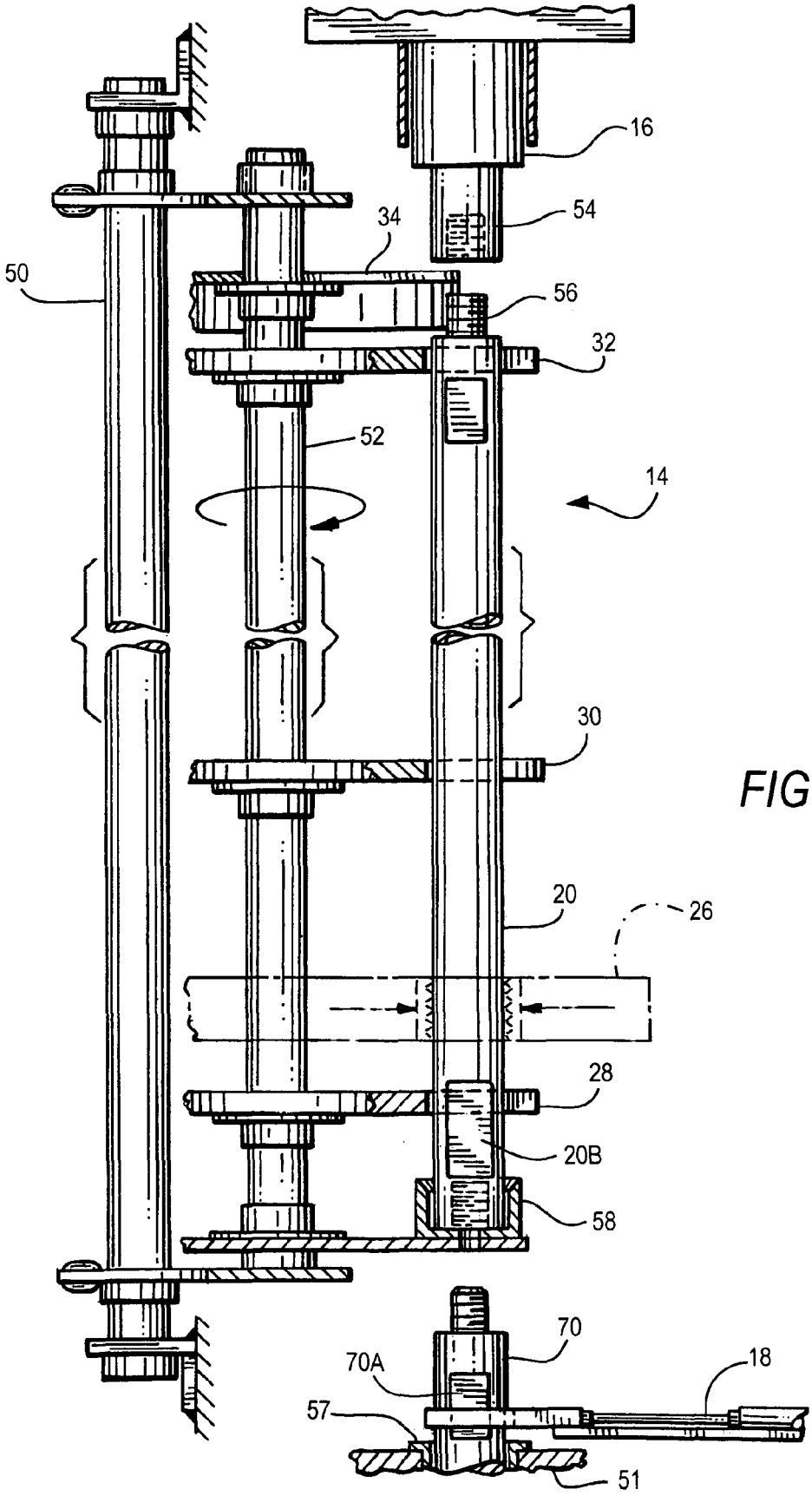
FIG. 9 is a partial vertical elevational view of the carousel, placing a drill extender in position for pickup by the rotary drive motor.
Figure 10:
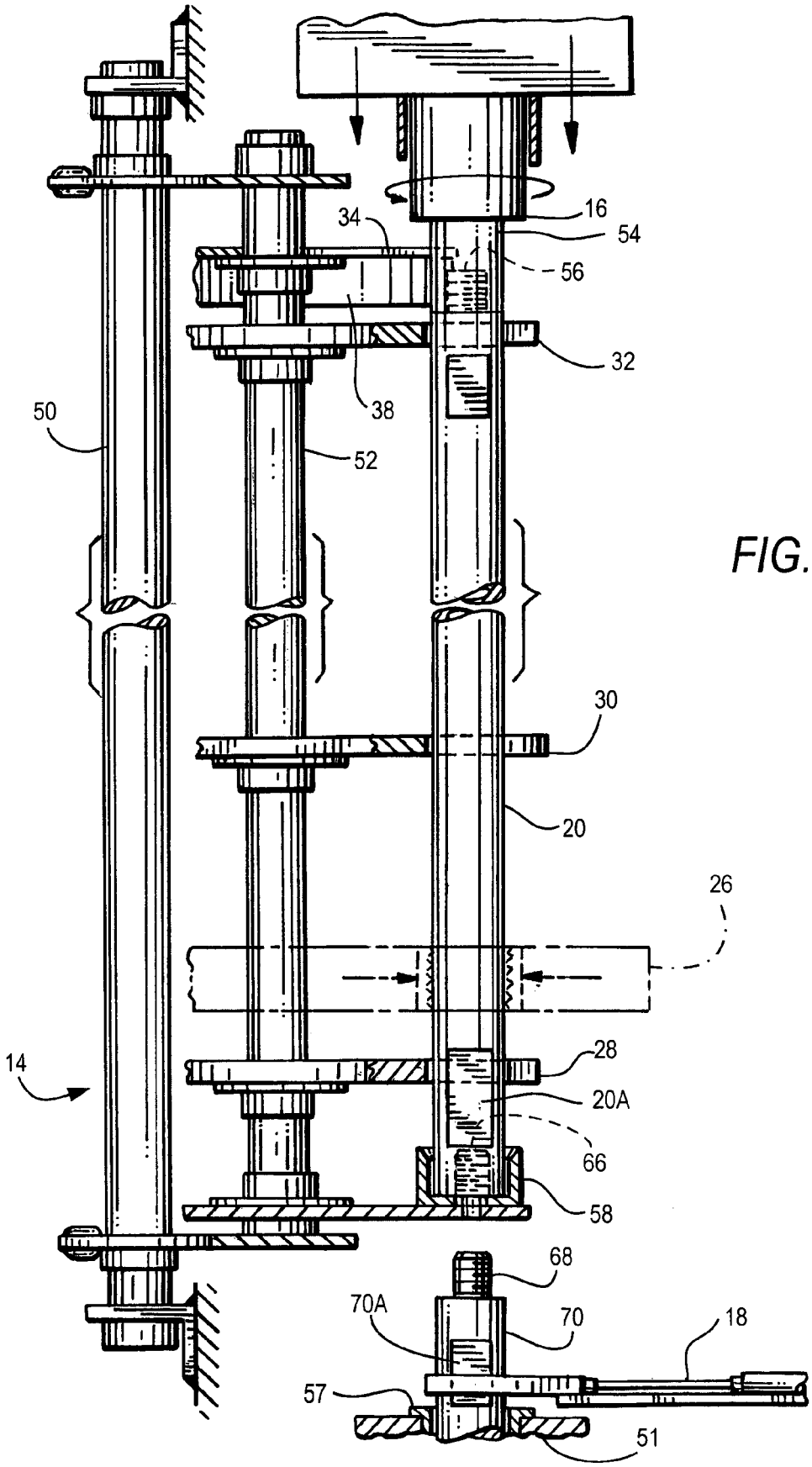
FIG. 10 is a partial vertical elevational view, similar to FIG. 9, showing the rotary drive motor locking down on the drill extender while being restrained by a wrench-like cutout opening of the primary breaker plate.
Figure 11:
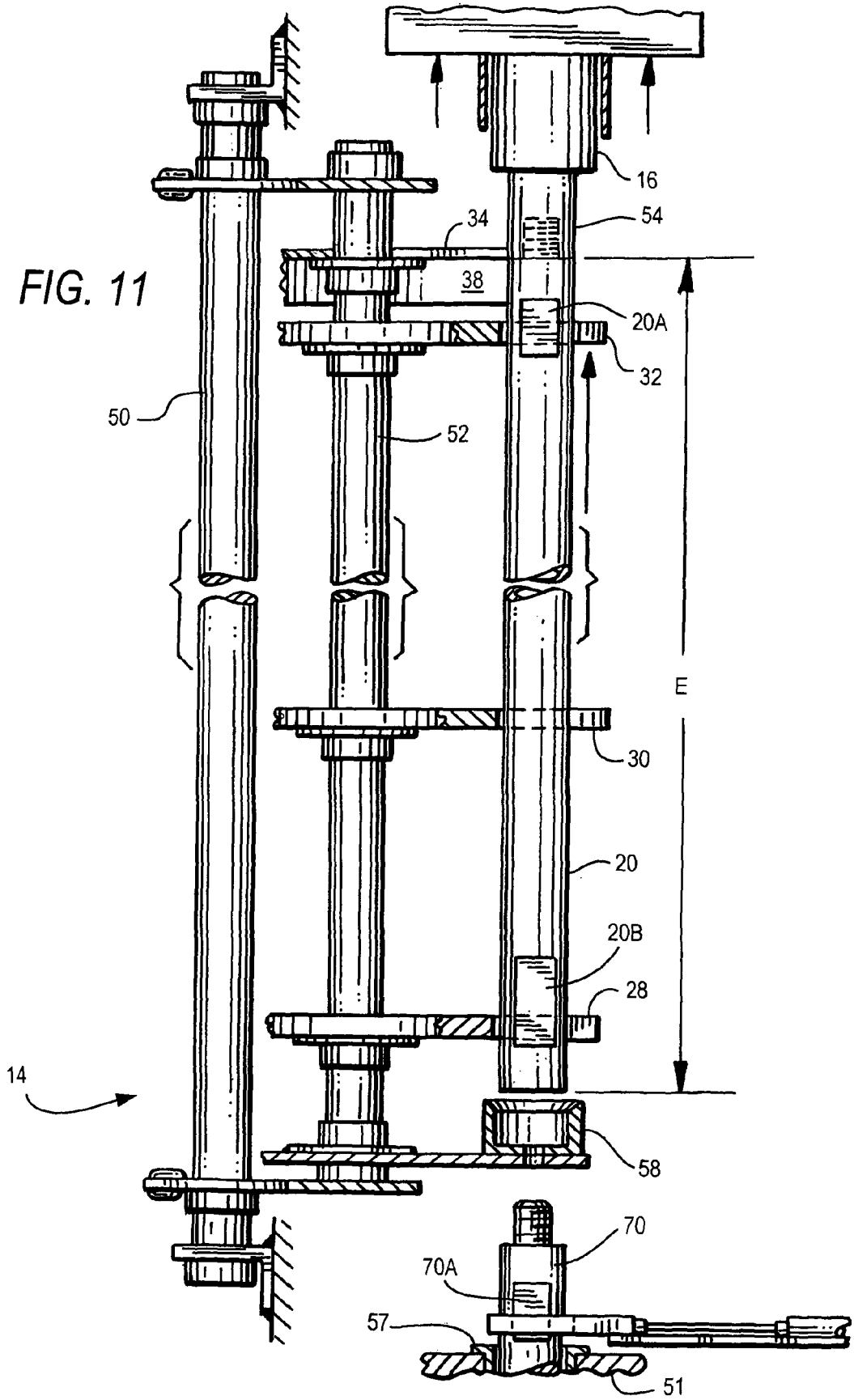
FIG. 11 is a partial vertical elevational view, similar to FIG. 10, showing the rotary drive motor in the process of lifting the drill extender out of the carousel pod prior to pivotal rotation of the carousel out of the way to the storage position, the drill extender being in a position to be released from the upper retainer plate and the primary breaker plate due to the new raised positions of the upper flat surfaces 20A on the drill extender as shown, which now correspond to the straight surfaces of the cutout openings of the upper retainer plate.
Figure 12:
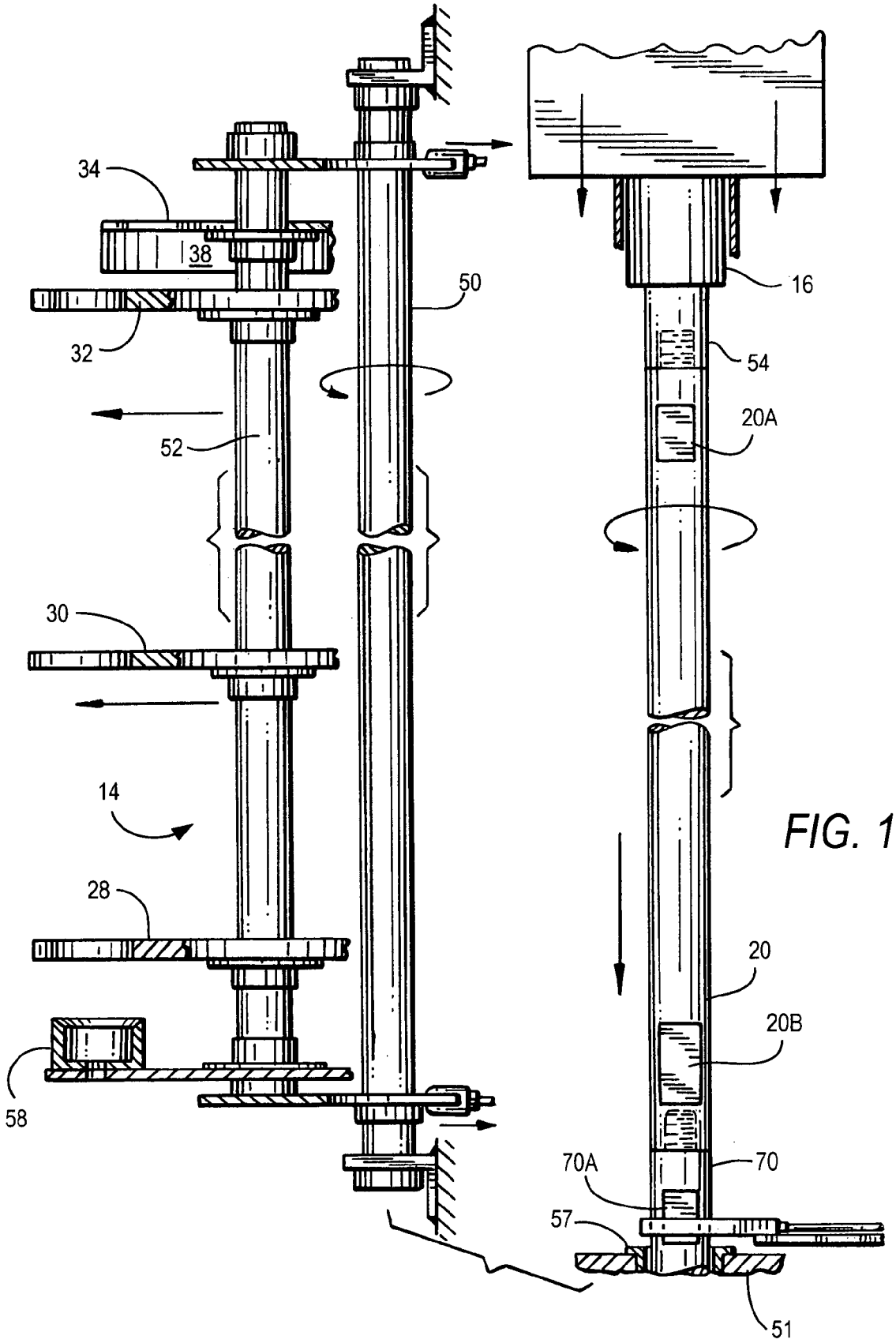
FIG. 12 is a partial vertical elevational view of the new drill extender threadedly engaging the previous extender located in the drill hole, after the carousel has been pivoted out of the way to the storage position, the sliding breakout fork wrench engaging the previous drilling extender to restrain it from rotating with the new extender being attached to it as shown.

Referring to FIG. 9, the carousel is pivoted inwardly toward the drill hole area from the rest position shown in FIG. 1, for attachment of a second drill extender 20 to the drill extender 70 which has already been advanced into the drill hole. The carousel is then rotated on its own axis about carousel shaft 52 to a position where a new drill extender 20 is located precisely over the previous drill extender 70 in the drill hole. Thereafter, the new drill extender 20 is selectively attached to the rotary drive motor 16 at the upper end as shown in FIG. 10. After attachment of the drill extender 20 to rotary drive motor 16, the rotary drive motor 16 lifts the drill extender out of carousel pod 58 as shown in FIG. 11. Thereafter carousel 14 is pivoted away from the drilling location as shown in FIG. 12, and the rotary drive motor 16 continues to rotate and drive the drill extender 20 downwardly to threadedly attach it to the previous drill extender 70 in the drill hole at the lower end as shown in FIG. 12. In FIG. 9, the drill extender 20 is restrained against rotation by a well known Hobo wrench 26 during the attachment of the drill extender 20 to the rotary drive motor 16. In FIG. 12, the drill extender 70 in the drill hole is restrained against rotation by the sliding fork wrench 18 which has legs with flat surfaces to engage the flat surfaces 70A on the drill extender 70 similar to the action of an open-end wrench.

After the attachment is complete, as shown in FIG. 12, the carousel is rotated once again to the rest position shown in FIGS. 1 and 12, and the drilling operation continuous with the rotary drive motor advancing downwardly and applying downward force and rotational torque to the entire combined drill extenders and drill tool until the last attached drill extender is advanced completely into the drill hole.

Figure 25:
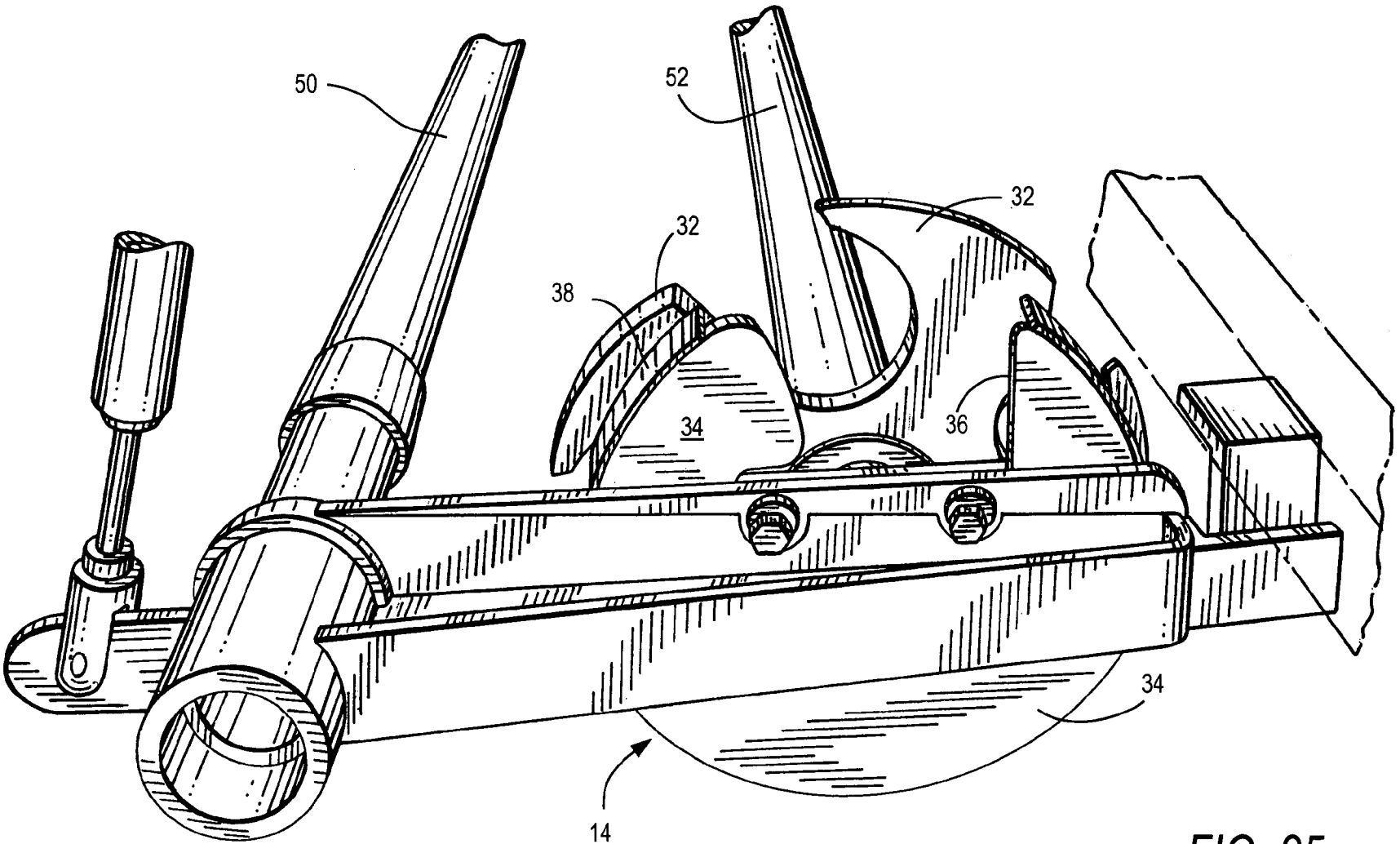
FIG. 25 is a top perspective view looking down at the rotating arm that holds the upper portion of the carousel, and showing the lock plate 34 and shroud 38 which retains the drill extenders from falling out of the carousel when the carousel is lowered to a horizontal orientation and rotated for loading with drill tools, this view also showing the upper retainer plate 32.

In FIG. 1 the drill tower 10 includes a carousel 14 which is shown in a rest position pivoted away from the drill hole location. The carousel 14 includes a primary breaker plate 28 at the lower end, and a secondary breaker plate 30 positioned also at the lower end, but above the location of the primary breaker plate 28. An upper retainer plate 32 is located at the upper end of the carousel 14. A lock plate 34 is positioned above the upper retainer plate 32 to lock the extender tools in position when the drill tower is pivoted to a horizontal position for purposes of loading and unloading the workpieces. In particular, when the drill tower 10 and carousel 14 are rotated to the horizontal position to load the equipment, the lock plate 34 includes a cutout 36 as shown in FIG. 25, for reception of the upper end portion of the drill extenders. When the carousel 14 is rotated on its axis to successively install each drill extender, as the carousel is rotated, the skirt 38 will prevent the drill extenders from falling out of the carousel. In addition, when the cab 12 is traveling uphill with the carousel in a horizontal orientation, the skirt 38 will prevent the drill extenders from falling out of the carousel.

Referring now to FIGS. 2 and 4-6, there is shown the primary breaker plate 28, the secondary breaker plate 30, and the upper retainer plate 32, each with their cutout openings for accommodating a workpiece such as a drill extender or drill adapter in corresponding positions as they are positioned in the carousel.

With upper retainer plate 32, the cutout openings 61, 60, 75, 76 are generally circular, with adjacent flat surfaces to permit releasing the drill extender when pivoting the carousel 14 away from the drill location to the rest position.

In the secondary breaker plate 30, the round cutout openings 41, 43 permit rotation of the drill extender when positioned therein, and the cutout openings 77, 78 are configured like open-end wrenches to prevent rotation of the drill extender when the flat surfaces 77A, 77B, engage the flat surfaces on the extender.

In primary breaker plate 28, open-end wrench-type cutout openings 37, 39 are the same as open-end wrench-type cutout openings 77, 78 in secondary breaker plate 42, but in opposite locations. Similarly, in primary breaker plate 40, circular cutout openings 45, 47 are the same as circular cutouts 41, 43 in secondary breaker plate 30, but in opposite locations.

Therefore, although a drill extender may be permitted to rotate in one of the circular cutout openings of one of the primary and secondary breaker plate, it will be restrained from rotation by the corresponding wrench-like cutout opening of the other breaker plate. The addition of the secondary breaker plate, with the configuration shown, has now made it possible to quickly threadedly attach or detach a drill extender/drill tool combination as quickly as was previously achieved in the prior art with just drill extenders alone. Given the fact that such drilling operations are generally accomplished with drill tools of approximately thirty or thirty-five feet in length, and of substantial weight, this quick changeover represents a significant advance in the art.

Figure 2:
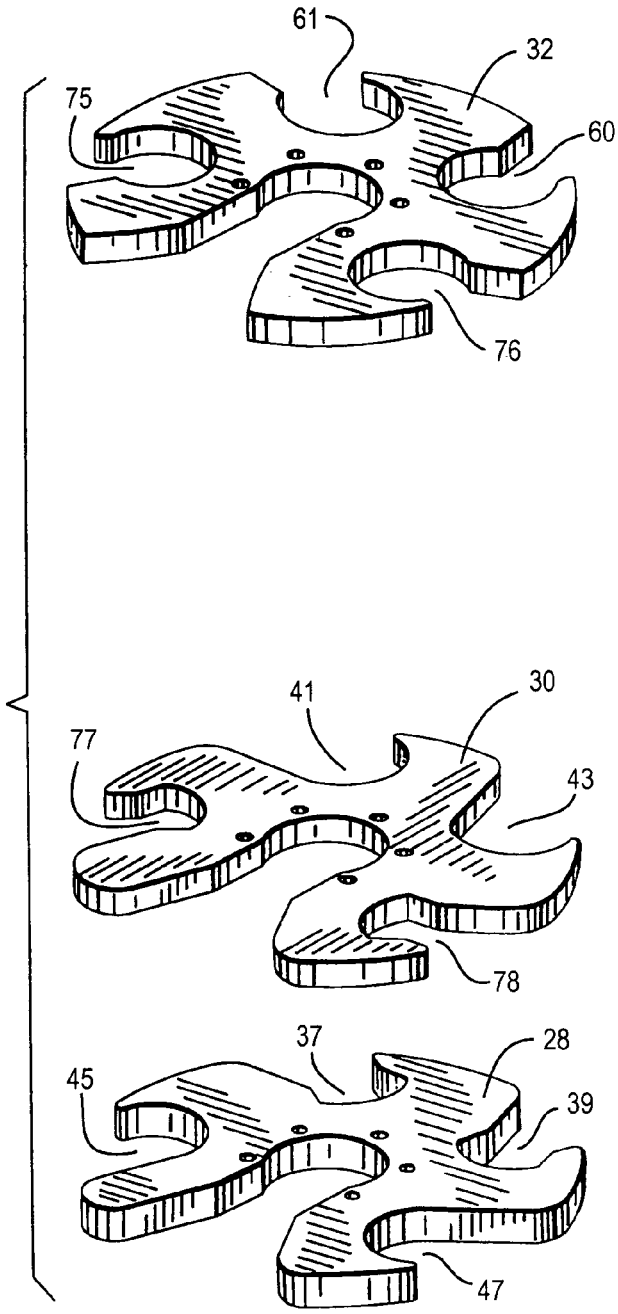
FIG. 2 shows top perspective views of the upper retainer plate, the secondary breaker plate, and the primary breaker plate, respectively from top to bottom.

FIG. 2 shows long and short adapters 19, 21 for use with a tricone drill tool and a hammer drill tool respectively, by attaching them with the drill tools and to drill extenders of approximately twenty-five and thirty feet, to be fitted into thirty and thirty-five foot carousels, respectively as described herein.

Figure 4:
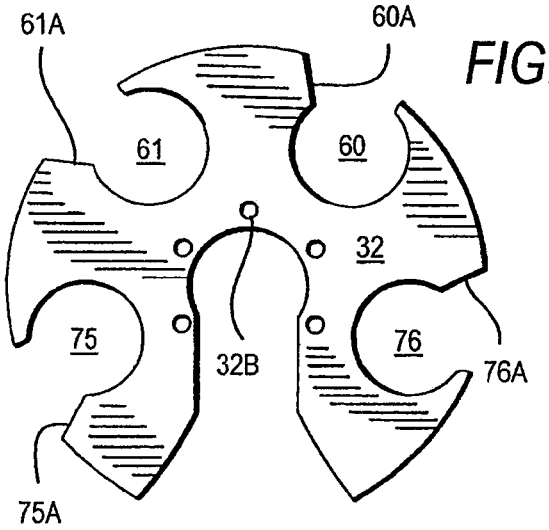
FIG. 4 is a top plan view of the upper retainer plate in a working orientation, when installed on the carousel of the present invention.
Figure 5:
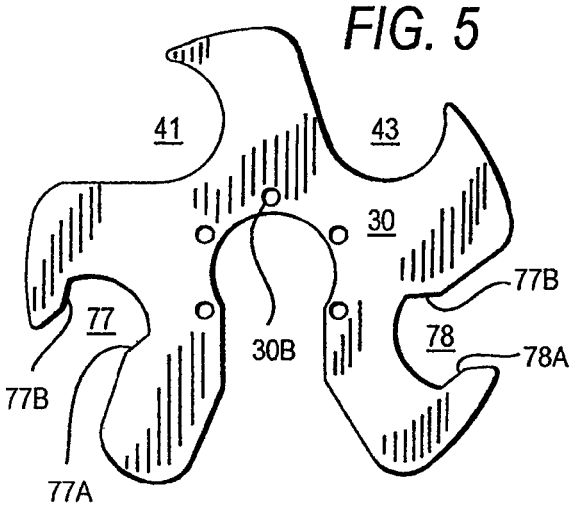
FIG. 5 is a top plan view of the secondary breaker plate in a working orientation corresponding to the orientation of the upper retainer plate, when installed on the carousel of the present invention.
Figure 6:
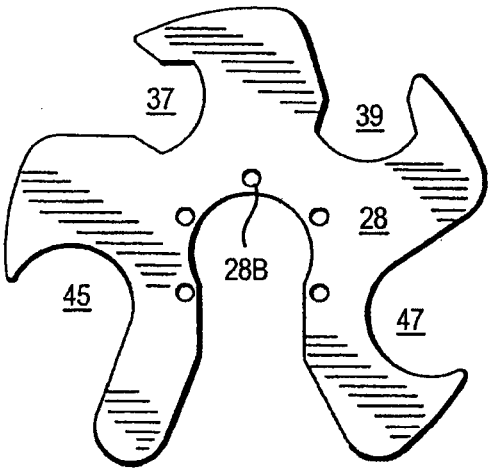
FIG. 6 is a top plan view of the primary breaker plate in a working orientation corresponding to the orientation of the secondary breaker plate and the upper retaining plate, respectively, when installed on the carousel of the present invention.

FIGS. 4, 5 and 6 respectively show the upper retainer plate 32, the secondary breaker plate 30, and the primary breaker plate 28 in top plan views in corresponding positions to illustrate the relative positions of the cutout portions of each of these devices when attached to the carousel through the five bolt holes 32B, 30B, and 28B, respectively, for operation.

FIG. 7 is a vertical elevational view of a typical drill extender 70 used for drilling in the present apparatus and showing the upper flat surfaces 70A for accommodating the primary breaker plate and the secondary breaker plate for engagement in a manner similar to an open-end wrench to maintain a rotational position of the drill extender for purposes of attaching or detaching it from another workpiece. Upper flat surfaces 70A are engaged by the sliding fork wrench when the drill extender is driven almost completely into the drill hole, leaving them exposed.

FIG. 7 shows the drill extender 70 with the lower respective flat surfaces 70B used for engagement by appropriate cutout portions of the secondary breaker plate 30 and the primary breaker plate 28 during the attachment and detachment of the drilling tools. Flat surfaces 75A, 61A, 60A and 76A on the upper retainer plate 32 are provided to permit withdrawal of the drill extender from the retainer plate 32 when the drill extender 70 is attached to rotary drive motor 16 and lifted upwardly out of the carousel pods and the carousel 14 is pivoted toward the rest position.

Figure 7A:
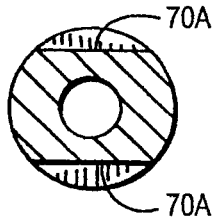
FIG. 7A is a cross-sectional view, taken along lines 7A-7A of FIG. 7, illustrating the flat surfaces which permit releasing the upper retainer plate from the drill extender when the carousel is pivoted away from the drill hole towards the rest position, as well as to restrain the drill extender from rotation by the sliding fork wrench when the drill extender has been completely advanced into the drill hole.
Figure 7B:
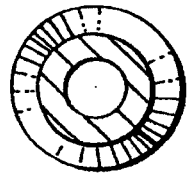
FIG. 7B is a cross-sectional view, taken along lines 7B-7B of FIG. 7, illustrating the neck of the drill extender having a circular outer circumferential surface immediately adjacent to the flat surfaces on the drill extender for reception of the drill extender into the upper retainer plate.

FIG. 7A shows the flat surfaces taken along lines 7A-7A of FIG. 7 and FIG. 7B shows the circular surface taken along lines 7B-7B of FIG. 7.

Figure 7C:
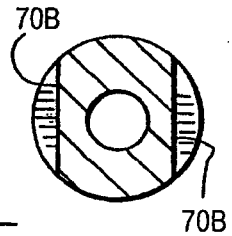
FIG. 7C is a cross-sectional view, taken along lines 7C-7C of FIG. 7, illustrating the flat surfaces used to restrain the drill extender from rotation by the primary and secondary breaker plates.

FIG. 7C shows the flat surfaces 70A taken along lines 7C-7C of FIG. 7.

Figure 8:
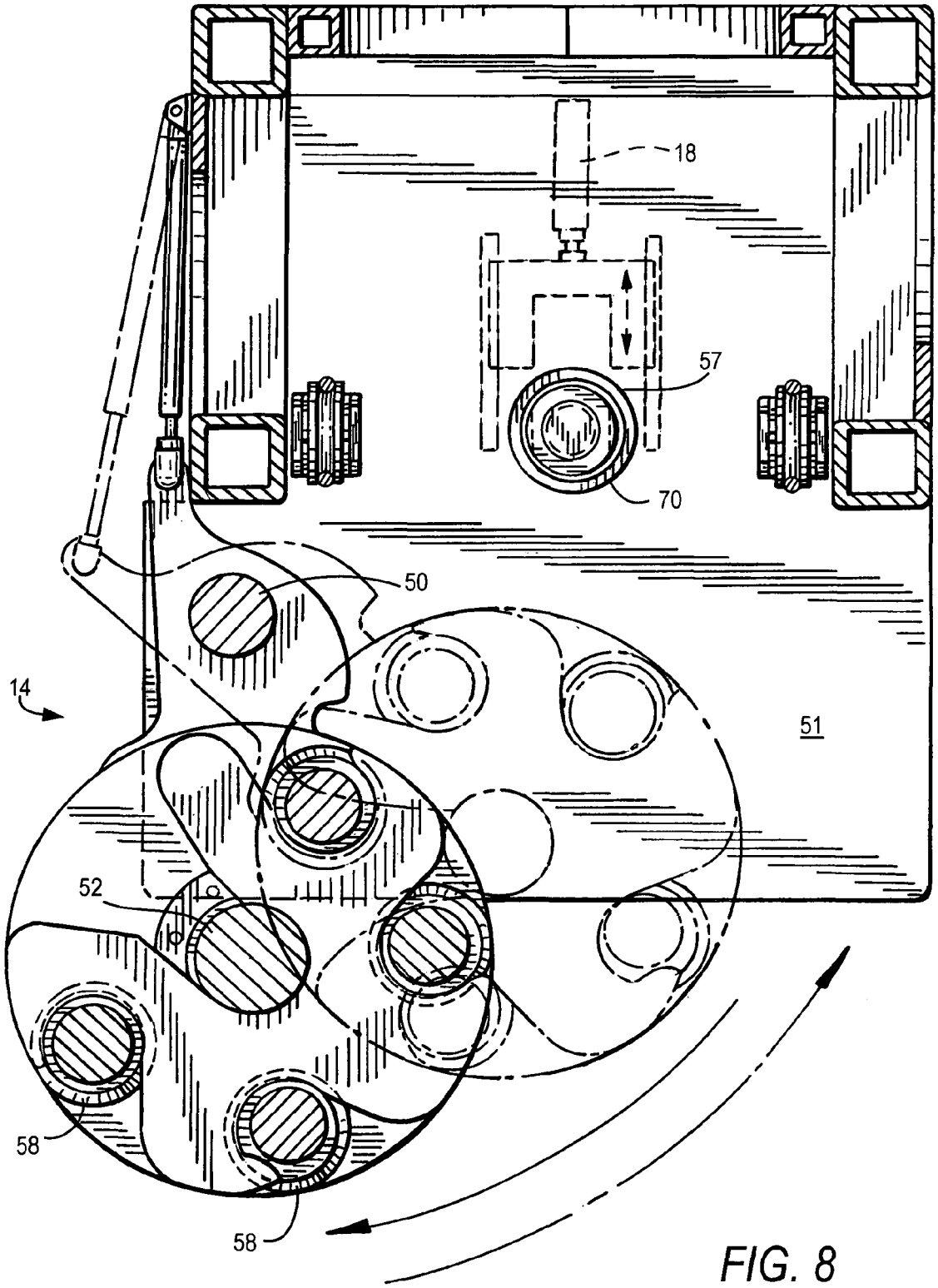
FIG. 8 is a view looking down at the lower section of the apparatus of FIG. 1, showing the inward and outward pivotal movement of the carousel.

FIG. 8 is a view looking down at the lowermost section of the apparatus of FIG. 1, showing the inward and outward pivotal movement of the carousel 14 toward and away from the drilling location.

FIG. 9 shows the carousel 14 after it has been pivoted about shaft 50 towards the drill hole and rotating about its own axis denoted by central carousel shaft 52, to place a drill extender 20 into position for continuing a drilling operation. Below the carousel is positioned the previous drill extender 70, which is already embedded in the drill hole, leaving exposed only the upper portion having flat surfaces 70A just above deck 51 and deck rod 57, for engagement by a sliding fork wrench 18 as shown in FIGS. 9 and 10.

In FIG. 9, the primary breaker plate cutout openings have flat sides which engage the flat surfaces of drill extender 20B to restrain it from rotation when the rotary drive motor 16 threadedly engages it as in FIGS. 10 and 11. The Hobo wrench in FIG. 9 also assists in restraining the drill extender 20.

In FIG. 10, the drill extender 20 is engaged the primary breaker plate 28, and assisted by a well known Hobo wrench 26 to restrain the drill extender from rotation. The Hobo wrench is shown more clearly and in perspective in FIG. 29. Once the Hobo wrench 26 grips the drill extender 20, the rotary drive motor 16 at the upper end of the drill tower with a female threaded shaft 54, and engages the upper male threaded portion 56 of drill extender 20 to threadedly attach the rotary drive motor 16 to the drill extender 20, while the Hobo wrench 18 retains the rotational position of the drill extender 20, by preventing it from rotating.

Figure 20:
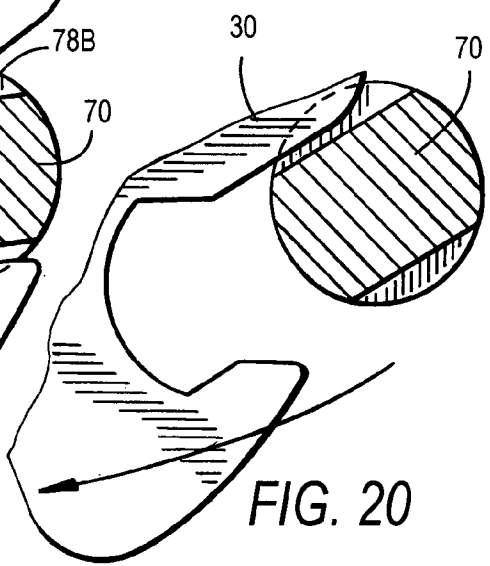
FIG. 20 is a view partially in cross-section, showing the secondary breaker plate withdrawing from the drill extender when the carousel is pivoted away from the drilling site.

Referring now to FIG. 11, once the drill extender 20 is raised upwardly to the position shown, by the attachment of the rotary drive motor thereto, the drill extender 20 has been lifted out of the carousel pod 58, and the flat surfaces 20A, are now raised to correspond for example, to the openings 60, 61 in the upper retainer plate, while cutout openings 39, 37 in the primary breaker plate 38, respectively remain aligned with the flat surfaces 20B, thereby permitting the carousel to be pivoted away from the tool extender as shown in FIGS. 12 and 20, once the attachment of the drill extender is complete. At this point the rotary drive motor 16 continues rotating clockwise as shown in FIG. 10, advancing the tool extender downwardly to align the female threaded end 66 of the tool extender 20 with the male threaded end 68 of the drill extender 70 already in the drill hole, to threadedly attach the drill extender 20 to the drill extender 70. At this time, the sliding breakout fork wrench 18 engages the flat surfaces 70A similar to the engagement of an open-end wrench, to retain the rotational position of the drill extender 70, while the new drill extender 20 is threadedly attached thereto.

Figure 13:
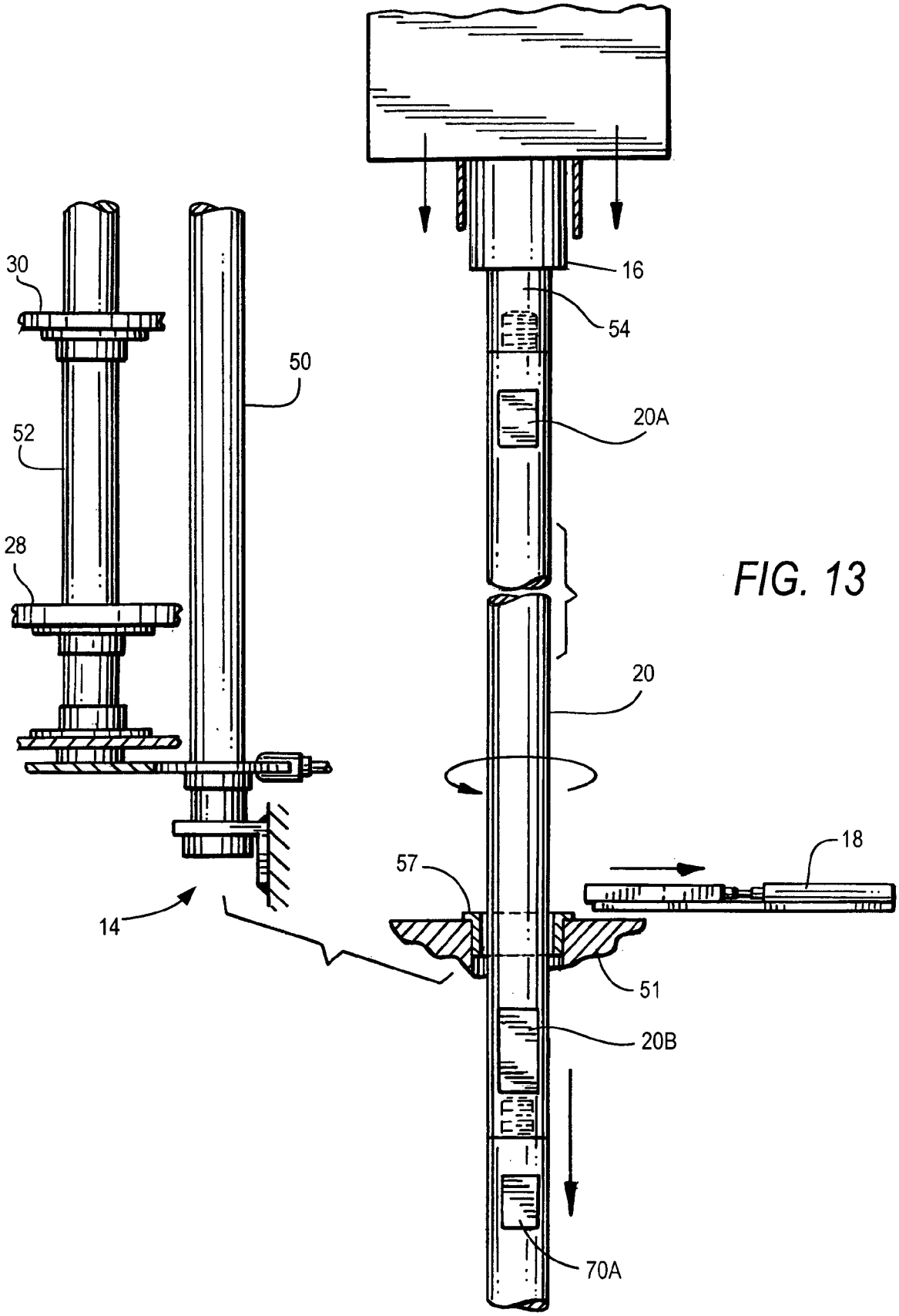
FIG. 13 is a partial vertical elevational view, similar to FIG. 12, showing the sliding breakout fork of wrench FIG. 12, used for securing the rotational position of the drill extender, moving away from the drill extender to permit the drill extender to continue the downward movement of the drilling procedure, the carousel being pivoted to the rest position away from the drill hole.

Referring to FIG. 13, the sliding fork 18 has now been withdrawn from the position of engagement with flat surfaces 70A of drill extender 70 in the drill hole. At this point the drilling continues, advancing with the rotary drive motor 16 and continuing to advance the combination of drill extenders 70, 20 and drill tool in the drill hole as shown in FIG. 13.

Figure 14:
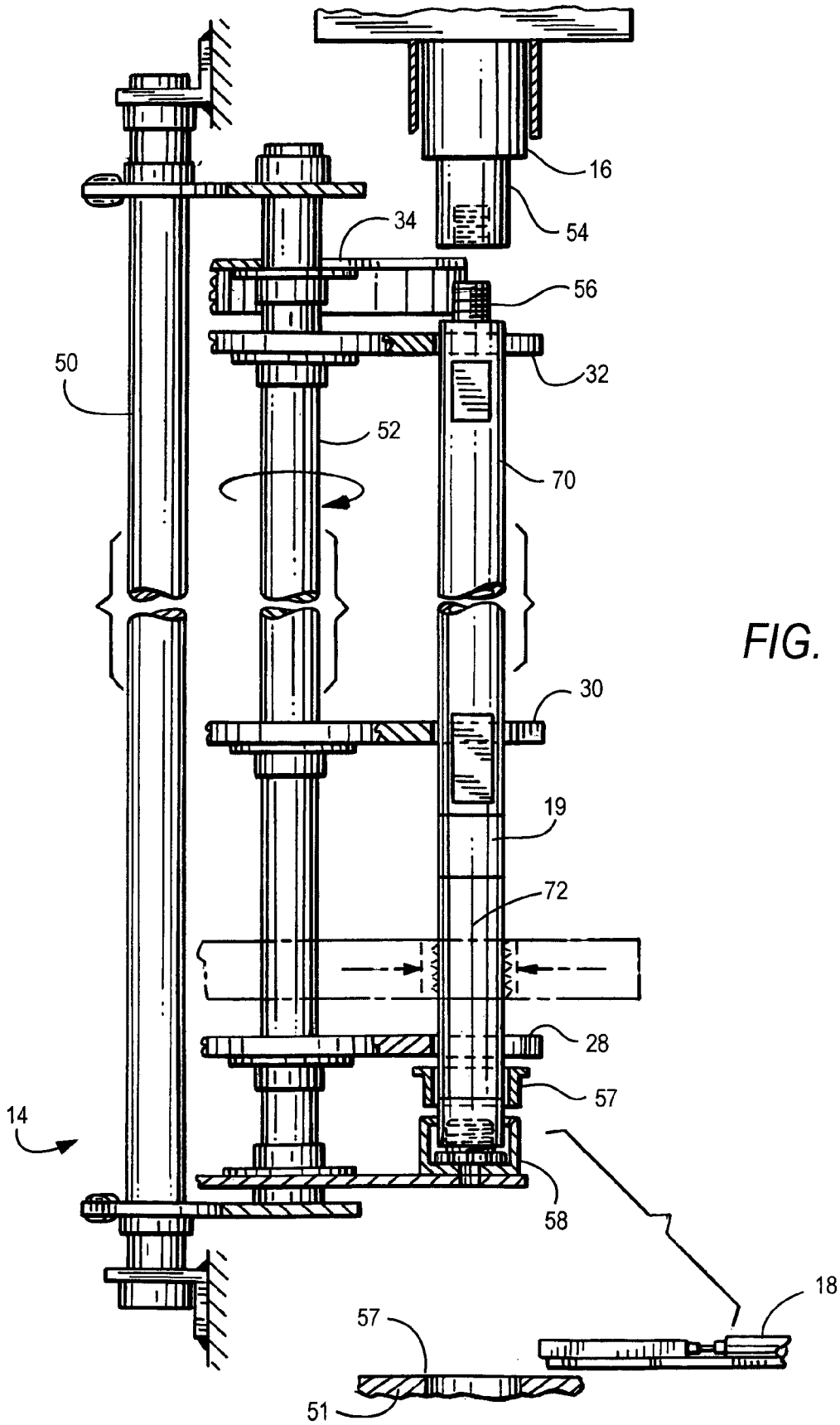
FIG. 14 is a partial vertical elevational view, showing the drill extender being restrained from rotation by a wrench-like cutout opening of the secondary breaker plate, while the optional Hobo wrench assists by gripping the hammer drill tool so that the rotary drive motor can be threadedly engaged with the drill extender.

Referring now to FIG. 14 there is shown the carousel 14 pivoted towards the drill hole in position for positioning a drill extender 70 which is attached to a hammer drill tool 72 and positioned in the carousel. The reason that the drill extender/hammer drill tool combination can now be positioned in the carousel is that the drill extender is twenty-five feet in length and is selected for example, for a thirty foot carousel. A twenty-five foot drill extender can be positioned in a thirty foot carousel, when combined with a hammer drill tool 72 and special hammer drill adaptor 74, as shown in FIG. 14. In particular, the hammer drill tool 72 is of predetermined length, or approximately four and one half feet. Therefore an approximately one-half foot adapter 19 is required to be attached to the hammer drill tool 72 and the drill extender in order to make the entire dimension of the combined drill extender and hammer drill tool equal to the dimension of the carousel, or thirty feet.

Figure 15:
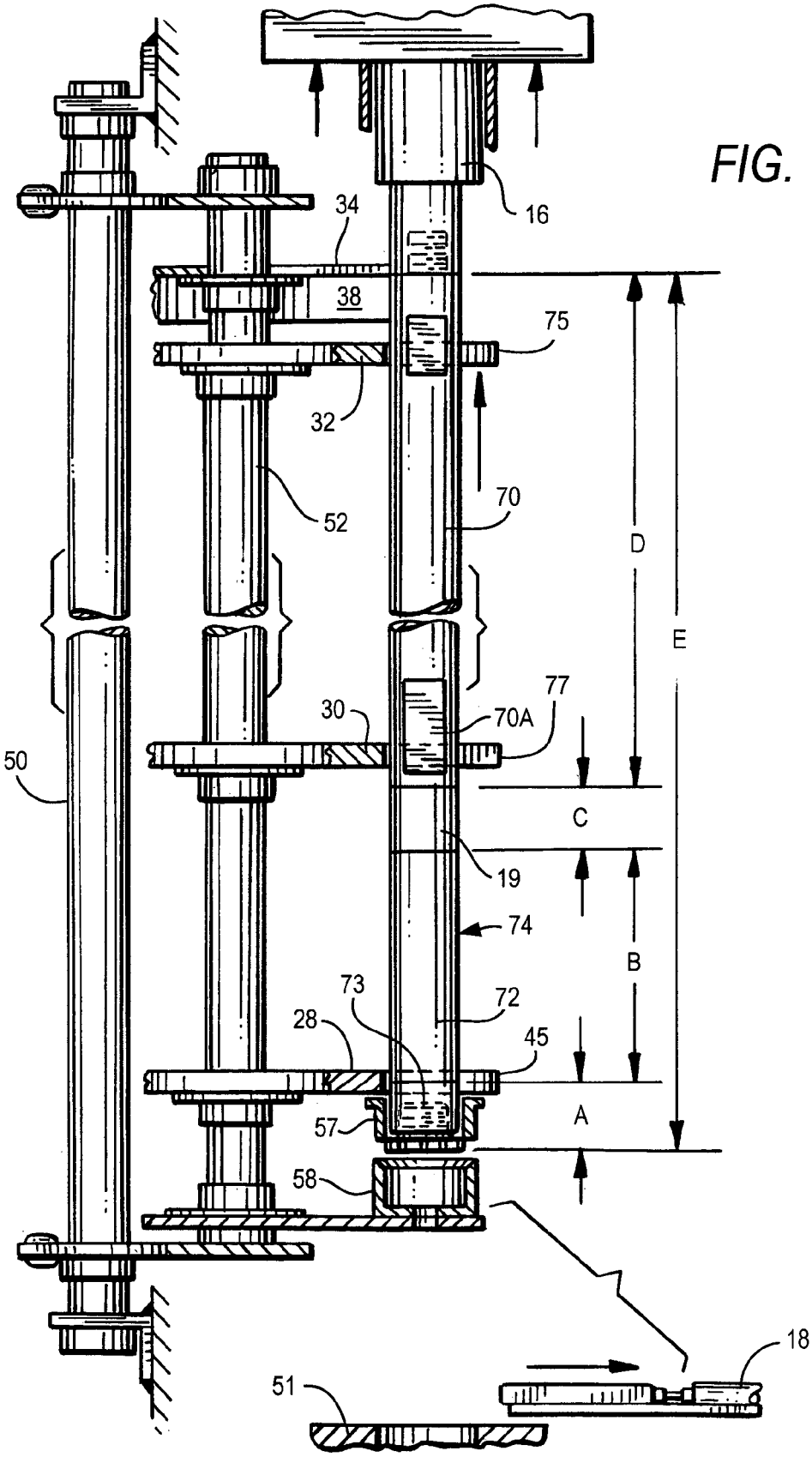
FIG. 15 is a partial vertical elevational view, showing the drill extender and hammer drill tool attached to the drive motor and being lifted out of the carousel pod.

For example, as shown in FIG. 15, the hammer drill tool 72 is of a predetermined dimension A. The hammer dill tool bit 73 is of length A. The hammer drill barrel 72 is a predetermined dimension B. According to the present invention an adapter 19 of length C is provided and predetermined in length so as to be combined with a standard size drill extender 70 of standard length D. For example, D may be a standard size drill extender of twenty-five or thirty feet in length. Accordingly, the combined dimensions of the hammer drill bit 73, the barrel 72 and adapter 19 complement the length of a standard size drill extender D in order to make the assembly fit entirely within the carousel 14, which is of length E, which in turn is the size of the next larger drill extender.

Since the standard sized drill extender 70 is now positioned above the hammer drill tool at a level immediately above the hammer drill tool, the primary breaker plate 28 cannot be utilized to restrain the combined tool as described when adding it to, or removing it from, the drilling operation because the open-end wrench-type openings of the primary breaker plate would not line up with the flat surfaces on the drill tool as a result of this elevated level. Accordingly primary breaker plate 28 is provided with cutout openings 45, 47. Secondary breaker plate 30 includes wrench-like openings 77, 78 and is located above the primary breaker plate, as a significant feature of the present invention, so that the level of the secondary breaker plate is aligned with the flat surfaces 70A of drill extender 70 in FIG. 15 in order to provide restraining torque to the combined tool, when adding the combined tool to, or subtracting it from, the drilling operation. Thus, in FIG. 15, drill extender 70 is positioned in one of circular cutout openings 45, 47 in primary breaker plate 28, and in one of the wrench-like cutout openings 77, 78 in secondary breaker plate 30, and one of cutout openings 75, 76 in retainer plate 32. Thus rotation of the drill extender 70 is restrained by secondary breaker plate 30.

Figure 17:
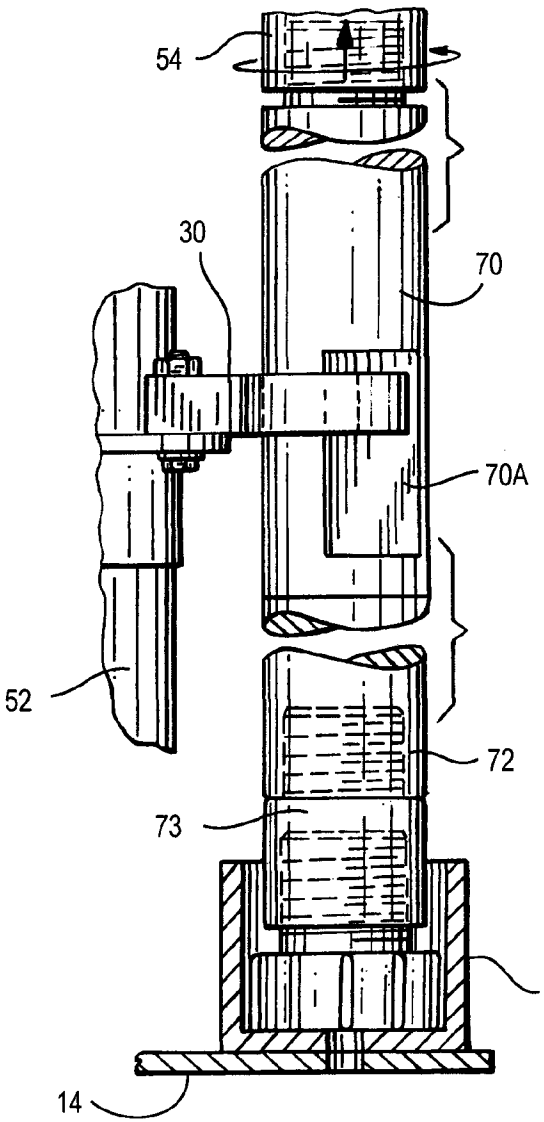
FIG. 17 is a partial vertical elevational view, taken along lines 17-17 of FIG. 16, illustrating the secondary breaker plate engaging the drill extender as in FIG. 16, while the rotary drive motor rotates counterclockwise to threadedly release the rotary drive motor from the drill extender.
Figure 16:
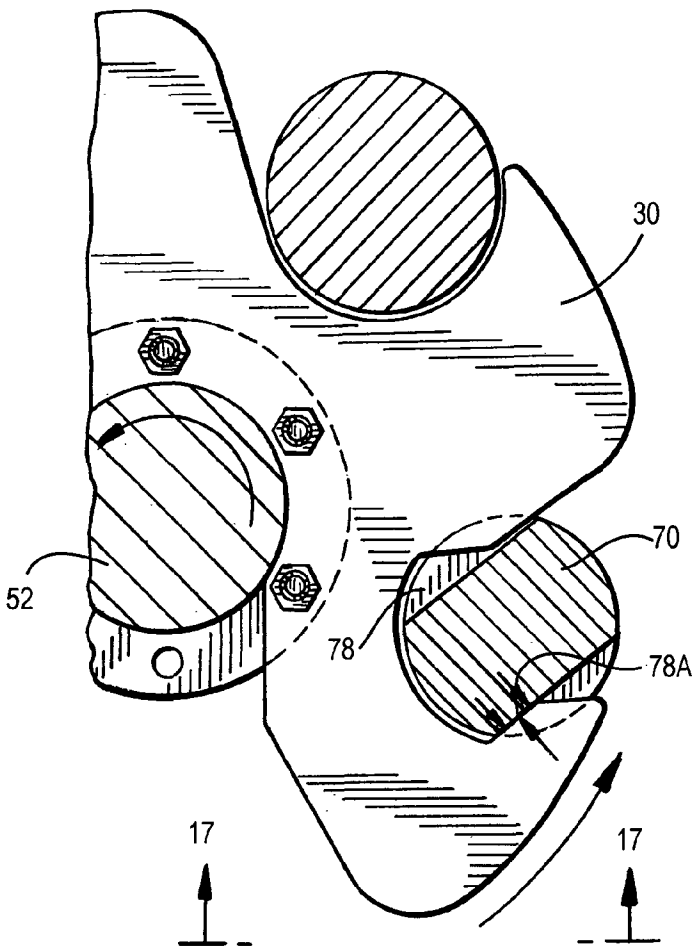
FIG. 16 is a view, partially in cross-section, of the secondary breaker plate engaging the flat surfaces on the drill extender to allow the unthreading of the rotary drive motor from the drill extender.

As noted, upper retainer plate 32 is in a position where drill extender 70 is located in one of openings 75, 76, while drill extender 70 is positioned in one of openings 77, 78 of secondary breaker plate 30. At the same time, the flat surfaces 70B of drill extender 70 are positioned in one of openings 77, 78 of secondary breaker plate 30, thereby providing the capability of restraining rotation of drill extender 70 during the process of attachment to, or detachment from, rotary drive motor 16 as shown in FIGS. 16 and 17. In particular, the cutout openings 77, 78 of secondary breaker plate 30 act as a restraining wrench which prevents rotation of drill extender 70 when the rotary drive motor 16 rotates counterclockwise to become threadedly released from the drill extender 70. The cutout openings 77, 78 of the secondary breaker plate 30 are actually in the form of a modified open-end wrench which have inwardly tapered sides which facilitate initial application of a force to break the threads when unthreading a drill extender from another component. In other words, when the drill extender is rotated to release a threaded engagement which has become over-tightened from use, the initial torque is applied when it is centered in the cutout openings 77, 78. However, after the rotation of the drill extender 70 begins, the additional space in the tapered opening provides a limited amount of momentum before it engages the surface 77B, 78A of the cutout openings 77, 78 of secondary breaker plate 30, with force sufficient to break the tight threaded engagement.

FIG. 17 is a partial vertical elevational view taken along lines 17-17 of FIG. 16, illustrating the secondary breaker plate 30 engaging the drill extender 70 as in FIG. 16, while the rotary drive motor 16 rotates counterclockwise to threadedly release the rotary drive motor 16 from drill extender 70 as described hereinabove.

Figure 19:
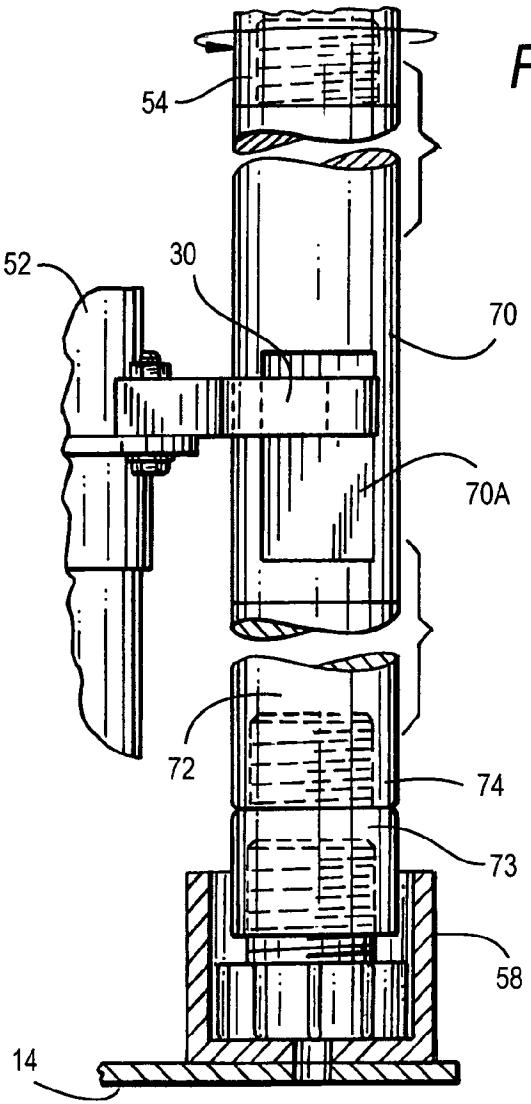
FIG. 19 is a vertical elevational view showing the secondary breaker plate engaging the drill extender as in FIG. 18, while the rotary drive motor rotates in a clockwise direction to threadedly attach the rotary drive motor to the entire tool assembly, which includes a hammer drill tool at the lowermost end.
Figure 18:
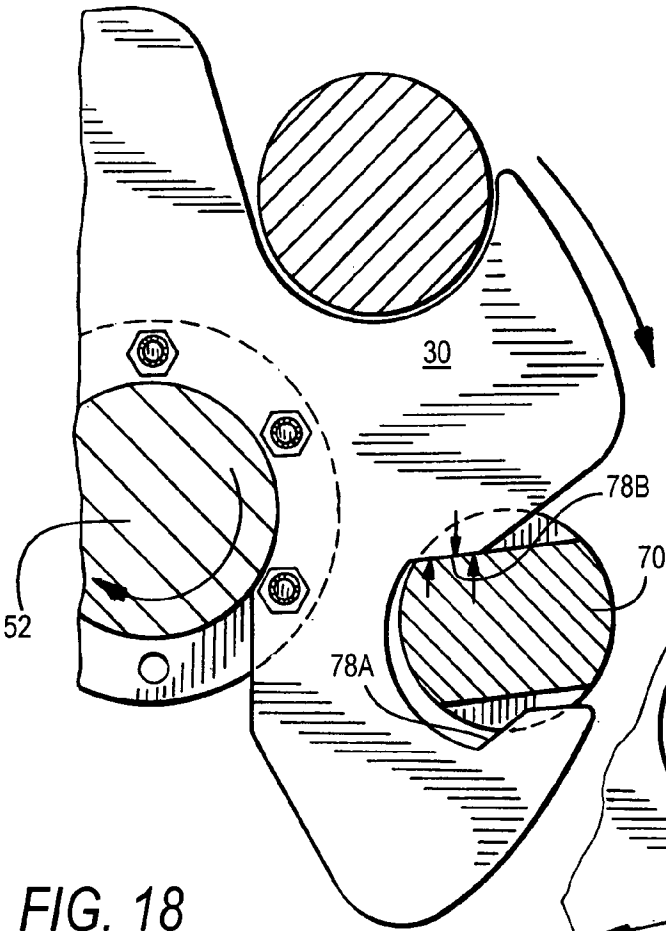
FIG. 18 is a view partially in cross-section, of the secondary breaker plate engaging the drill extender while the rotary drive motor rotates in a clockwise direction to threadedly attach the drill extender to a lower drill extender which already is positioned in the drill hole.

FIGS. 18 and 19 show the drill extender 70 engaged with the opposite surface 78B of cutout opening 78 of secondary breaker plate 30 when the rotary drive motor 16 is rotated clockwise to attach the rotary drive motor 16 to the combined drill extender 70 and hammer drill tool 74. In particular, the secondary breaker plate 30 is in engagement with the flat surfaces 70A of drill extender 70 in order to threadedly attach the drill extender 70 and hammer drill tool 74 with the rotary drive motor 16.

FIG. 20 is a view partially in cross-section, showing the secondary breaker plate 30 withdrawing from the drill extender 70 when the carousel 14 is pivoted away from the drilling site and towards the rest position.

Figure 21:
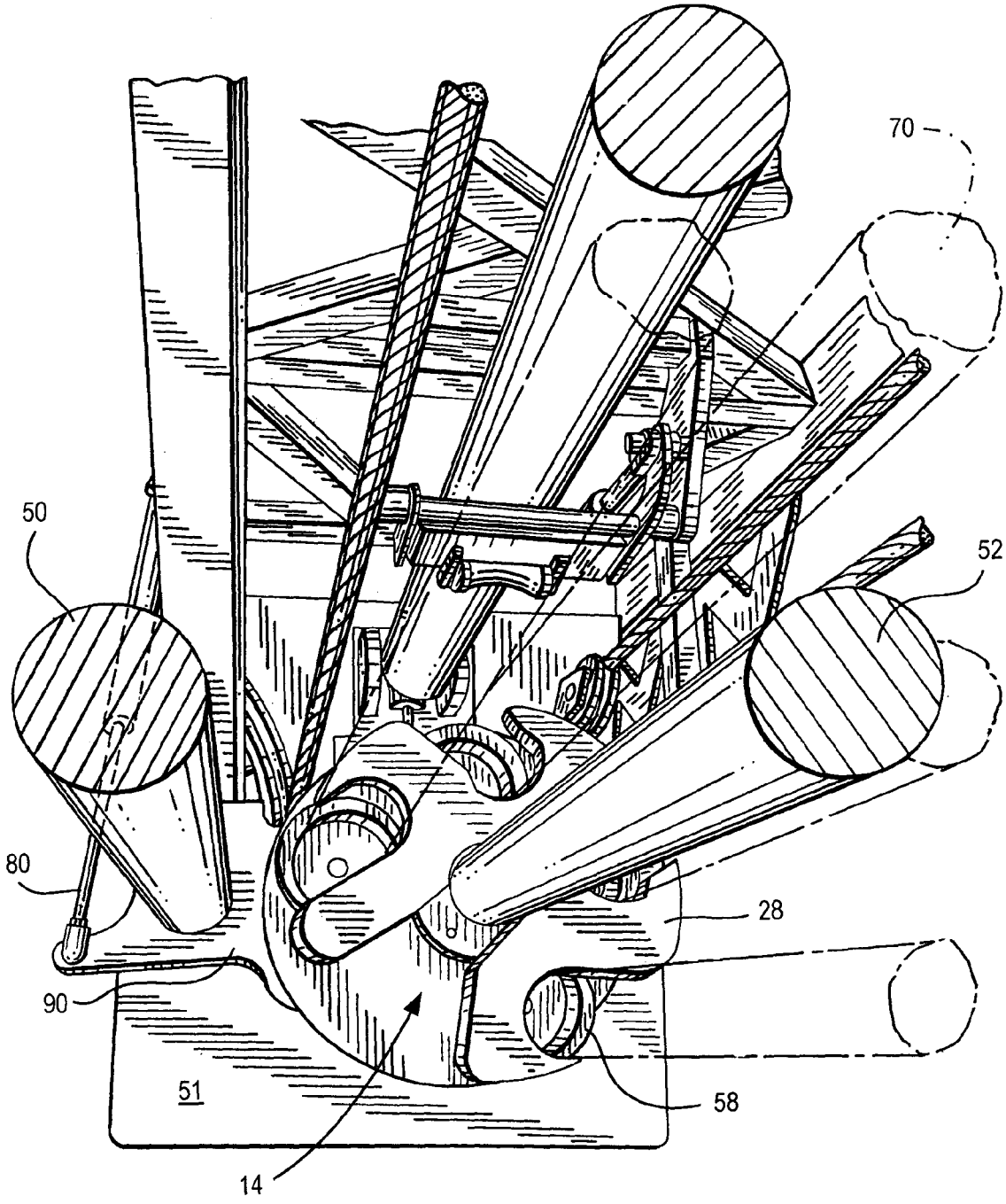
FIG. 21 is a perspective view looking down at the lower part of the drill tower and carousel, showing the cable and pulley system for raising and lowering the rotary drive motor.

FIG. 21 is a view looking down at the lower part of the drill tower 10 and carousel 14, showing the cable and pulley system which is used for raising and lowering the rotary drive motor by known means.

Figure 22:
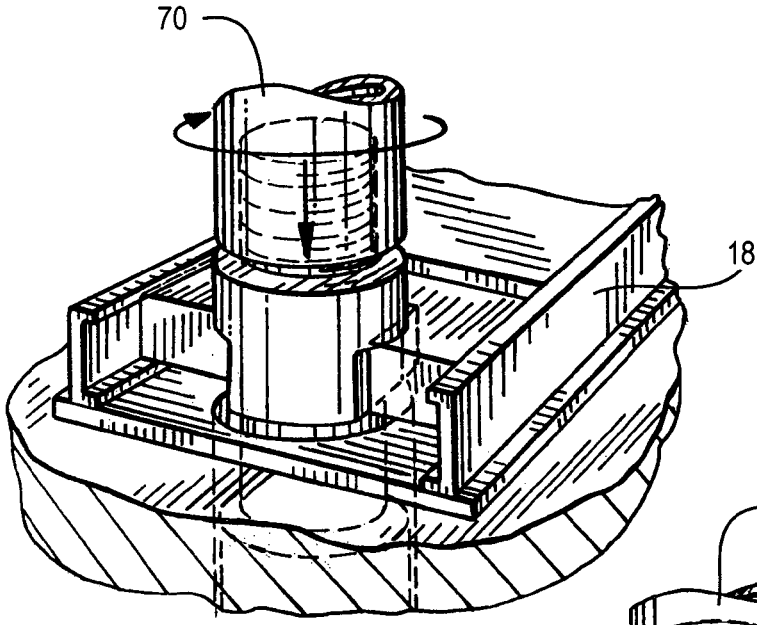
FIG. 22 is a top perspective view of the sliding breakout fork wrench of FIG. 13 in position to rotatably secure a drill extender already in the drill hole, while another drill extender is being threadedly attached thereto.
Figure 23:
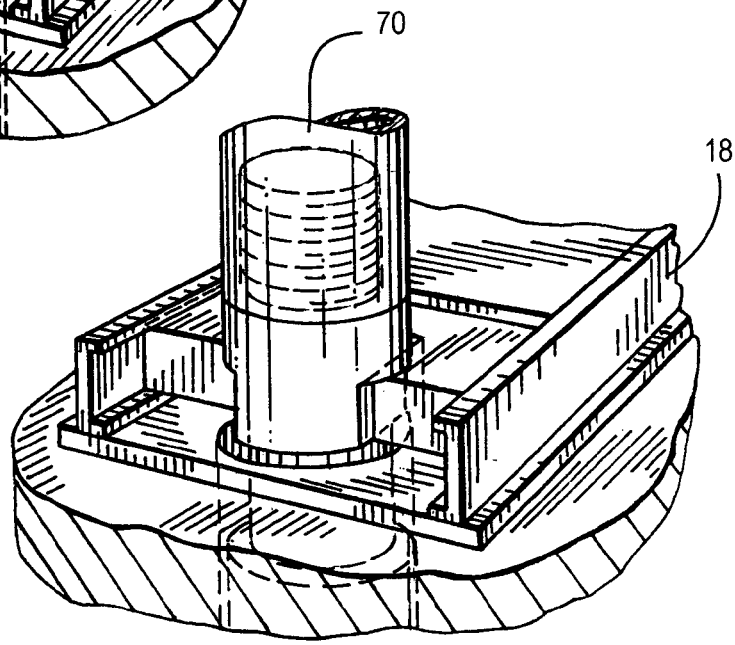
FIG. 23 is a top perspective view similar to FIG. 22, showing the drill extenders threadedly attached to each other and the sliding breakout fork wrench in position to restrain the drill extender in the drill hole from rotation.
Figure 24:
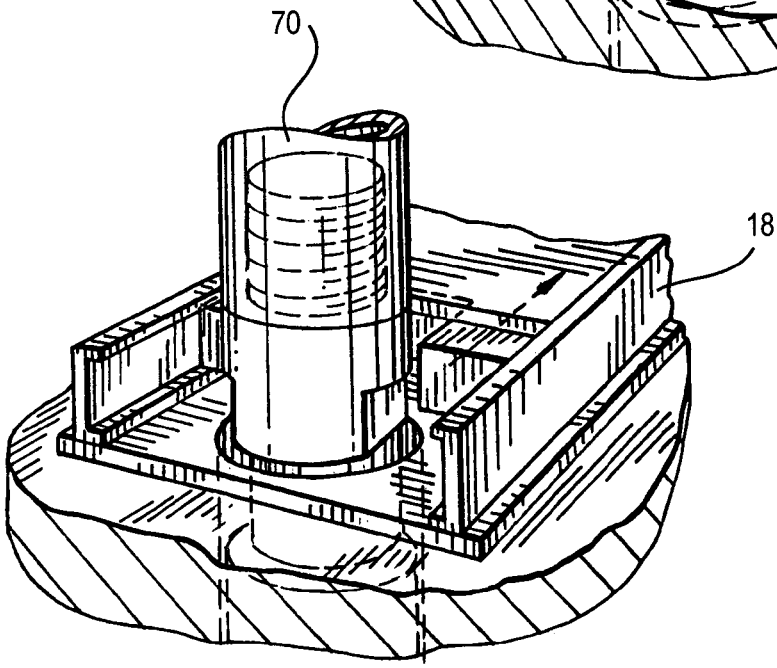
FIG. 24 is a top perspective view, similar to FIGS. 22 and 23, showing the sliding breakout fork wrench being withdrawn from the position in engagement with the drill extender in the drill hole after the upper drill extender has been attached to it as shown in FIGS. 22 and 23.

FIGS. 22, 23 and 24 illustrate the sliding breakout fork wrench 18 in various positions to restrain a drill extender 70 already positioned in a drill hole for threadedly attaching or removing a subsequent drill extender with respect thereto.

FIG. 25 is a top perspective view looking down at the rotating arm which holds the upper portion of the carousel 14, and showing the lock plate 34 with skirt 38, which retains the drill extenders in position on the carousel when the drill tower is pivoted to a horizontal position for loading or unloading the drilling equipment.

Figure 26:
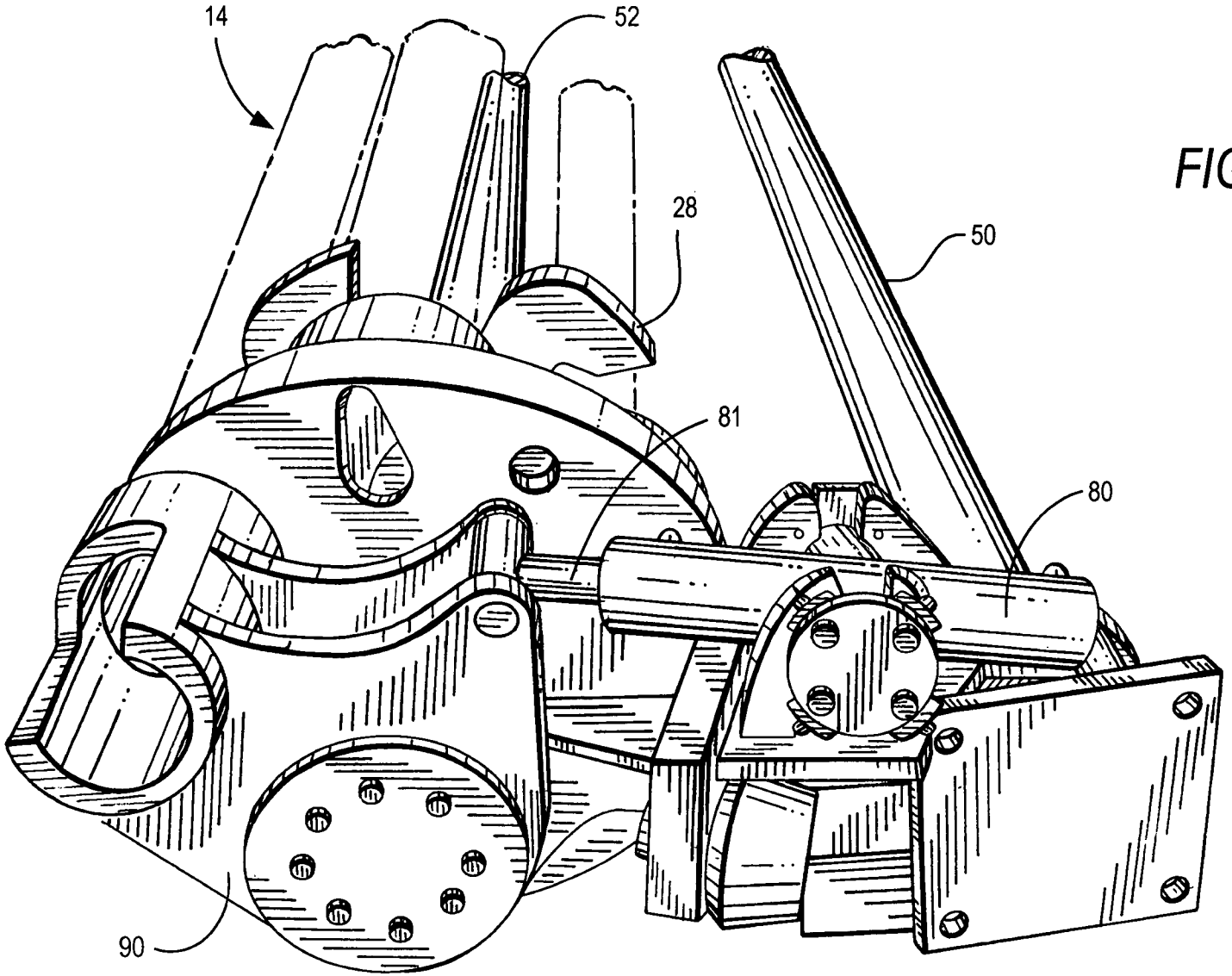
FIG. 26 is a bottom perspective view looking up at the lower portion of the carousel and at the bottom of the carousel, illustrating the indexer therefor.

FIG. 26 is a bottom perspective view looking up at the lower portion of the carousel 14 and at the bottom of the carousel 14, illustrating the indexer 90 therefor. In particular, the indexer 82 of the carousel 14 operates as follows. When the carousel 14 is rotated about its own central shaft 52 to position a particular drill extender or combined drill tool over the drill hole, the hydraulic cylinder 80 selectively moves to the position shown in FIG. 28 to select a position desired to be rotated to the drill hole position. When the hydraulically operated arm 82 is located below the selected position, a pin 84 is made to move upwardly (i.e., by remotely controlled electrical solenoid or the like) and engage an aperture 86 in the carousel pod as shown. Thereafter the carousel 14 is rotated selectively by movement of hydraulic piston arm 81 of piston 80 to the location which is desired to position a particular drill extender or drill tool over the drill hole.

Figure 27:
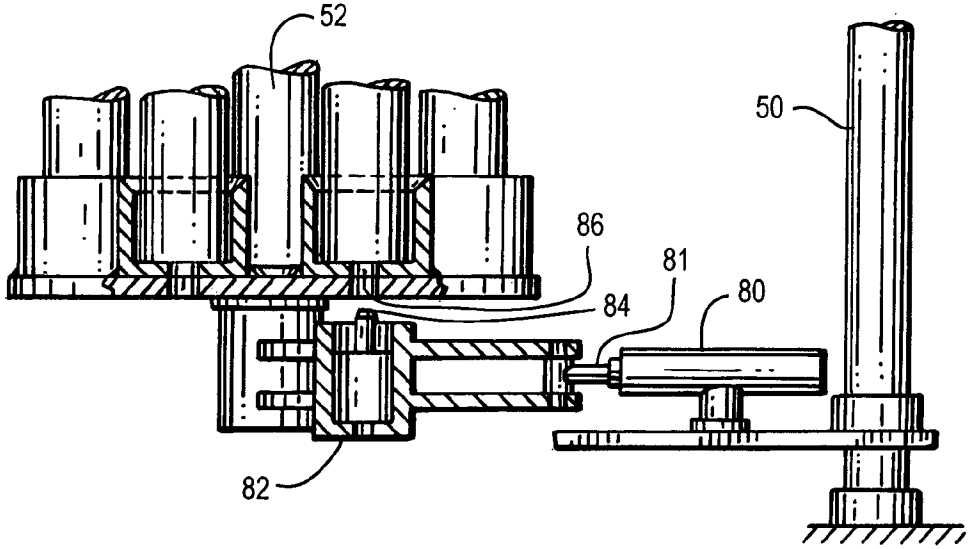
FIG. 27 is a diagrammatic vertical elevational view of the carousel indexer, partially in cross-section, before the drive pin engages the pod disc.

FIG. 27 is a diagrammatic vertical elevational view of the carousel indexer, partially in cross-section, before the drive pin engages the pod disc.

Figure 28:
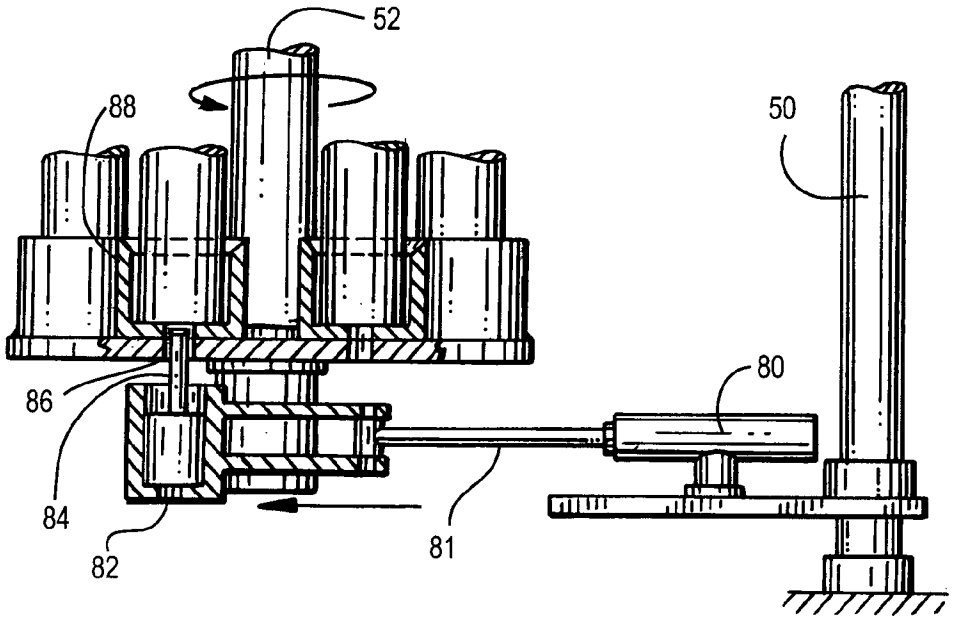
FIG. 28 is a diagrammatic vertical elevational view, showing the indexing pin engaged with the pod disc and moving it to the next position.

FIG. 28 is a diagrammatic vertical elevational view, showing the indexing pin engaged with the pod disc and moving it to the next position.

Figure 29:
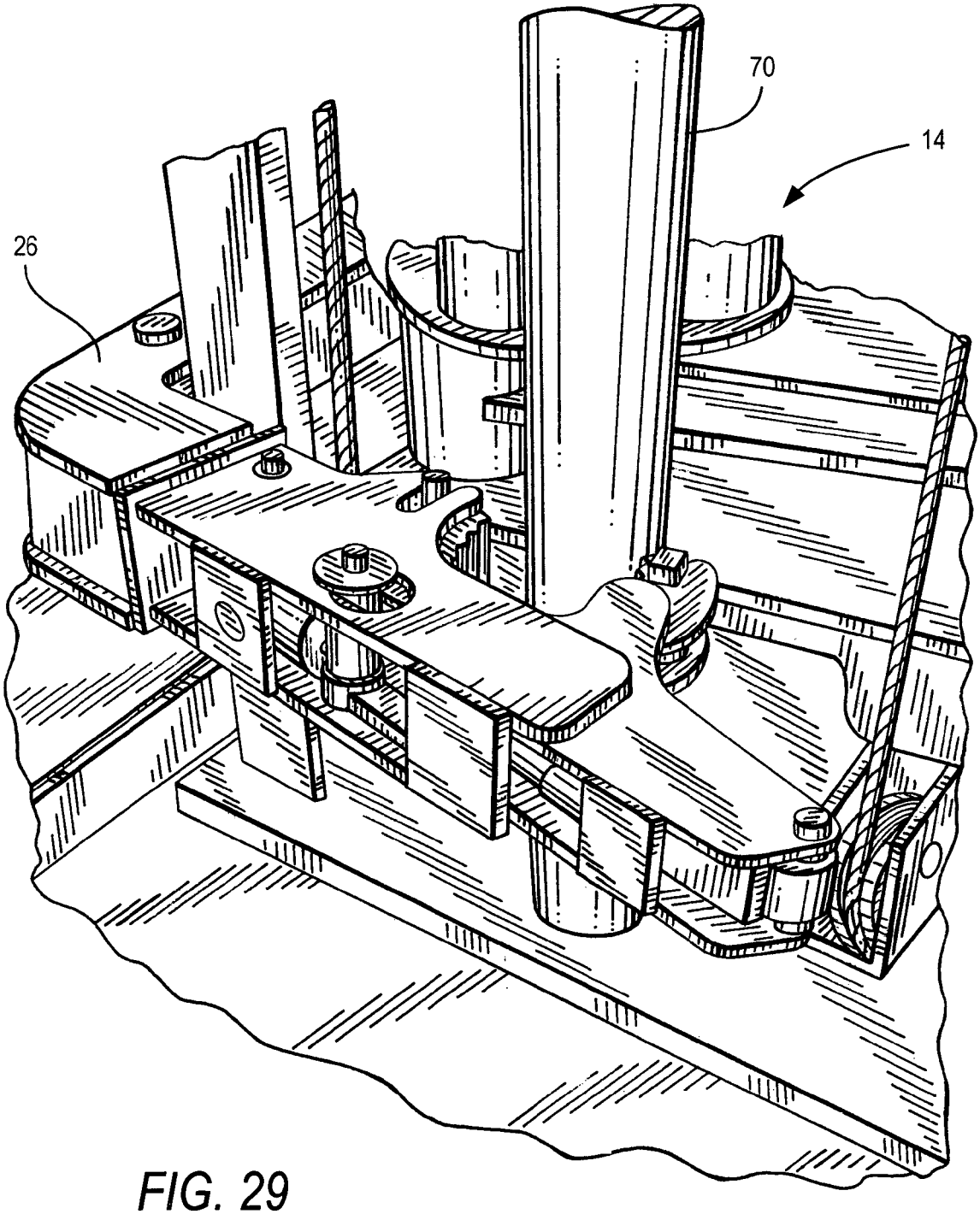
FIG. 29 is a vertical elevational view of the lower portion of the drill tower, showing the hobo wrench moving inwardly to grip the drill extender.

FIG. 29 is a top perspective view of the lower portion of the drill tower, showing the Hobo wrench 26 moving inwardly to grip the drill extender 70.

Figure 30:
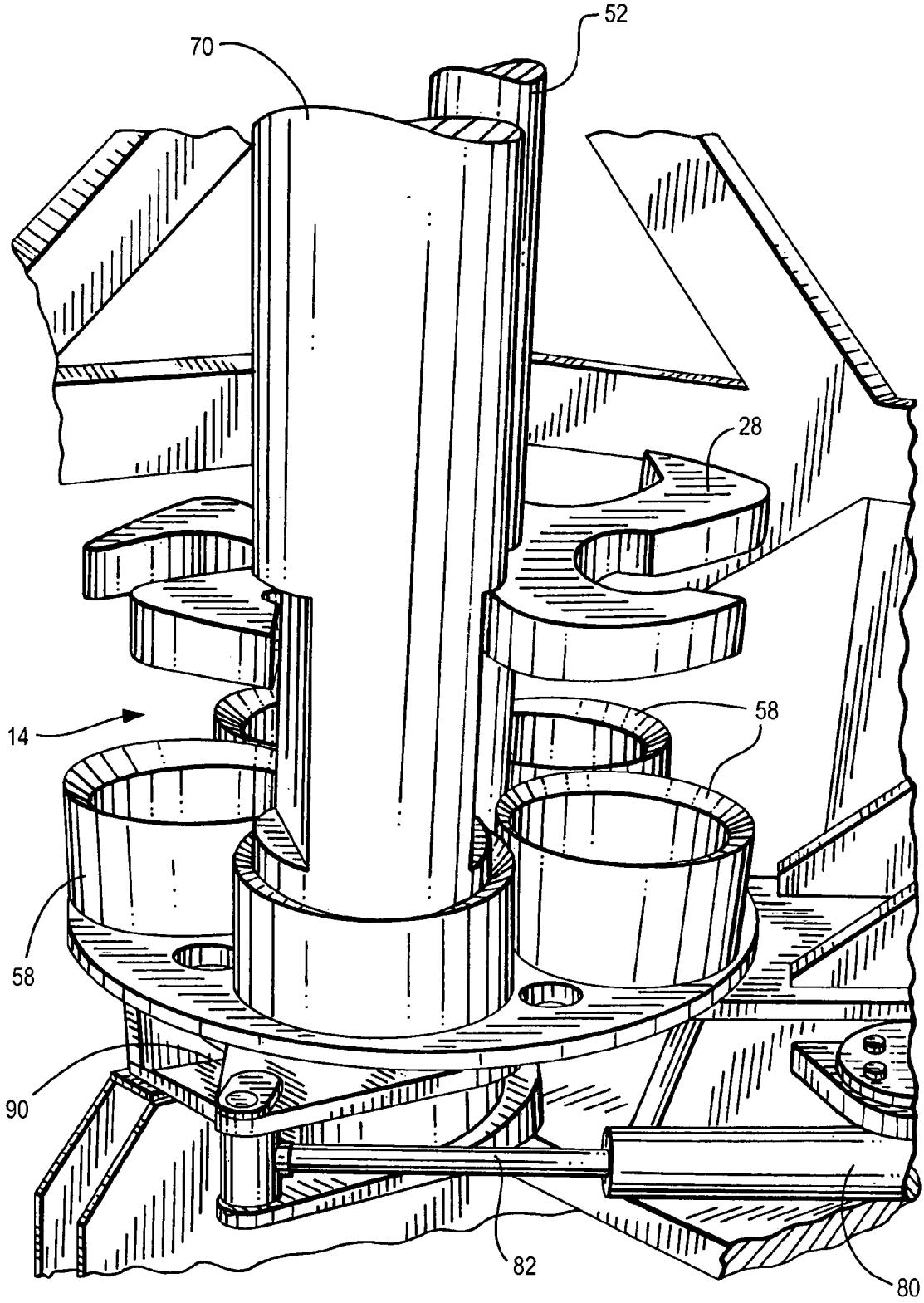
FIG. 30 is a top perspective view of the lower portion of the carousel, including a partial view of the indexer.

FIG. 30 is a top perspective view of the lower portion of the carousel 14, including a view of the indexer 90 described hereinabove.

Figure 31:
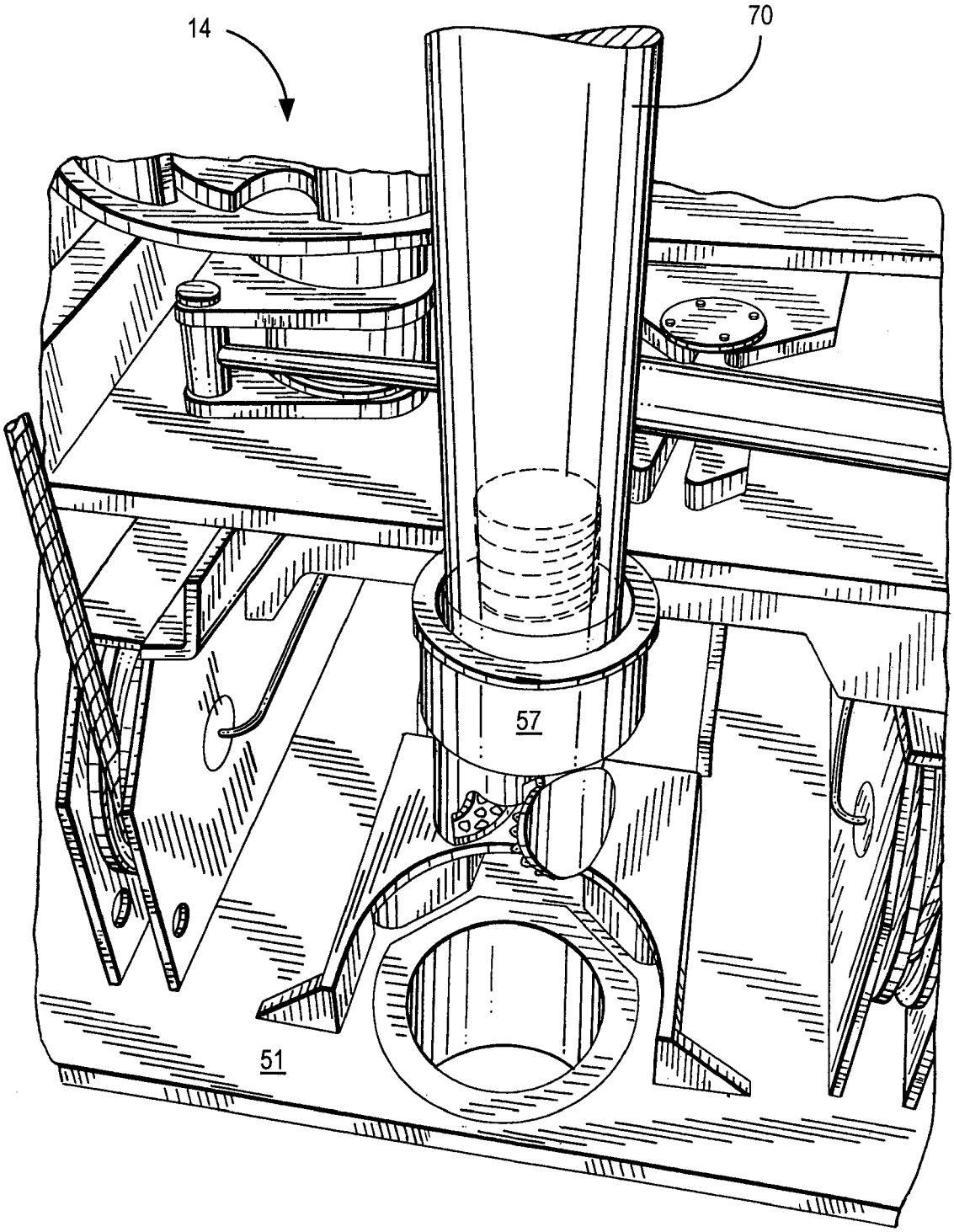
FIG. 31 is a top perspective view of the lower portion of the drill tower, showing a deck bushing on the end portion of a tricone drill tool, the drill tool attached to the drill extender and positioned just above the deck and over a drill hole.

FIG. 31 is a top perspective view of the lower portion of the drill tower 10, showing a deck bushing 57 on the end portion of a tricone drill tool, the drill tool attached to the drill extender 70 and positioned just above the deck 51 and over a drill hole.

Figure 32:
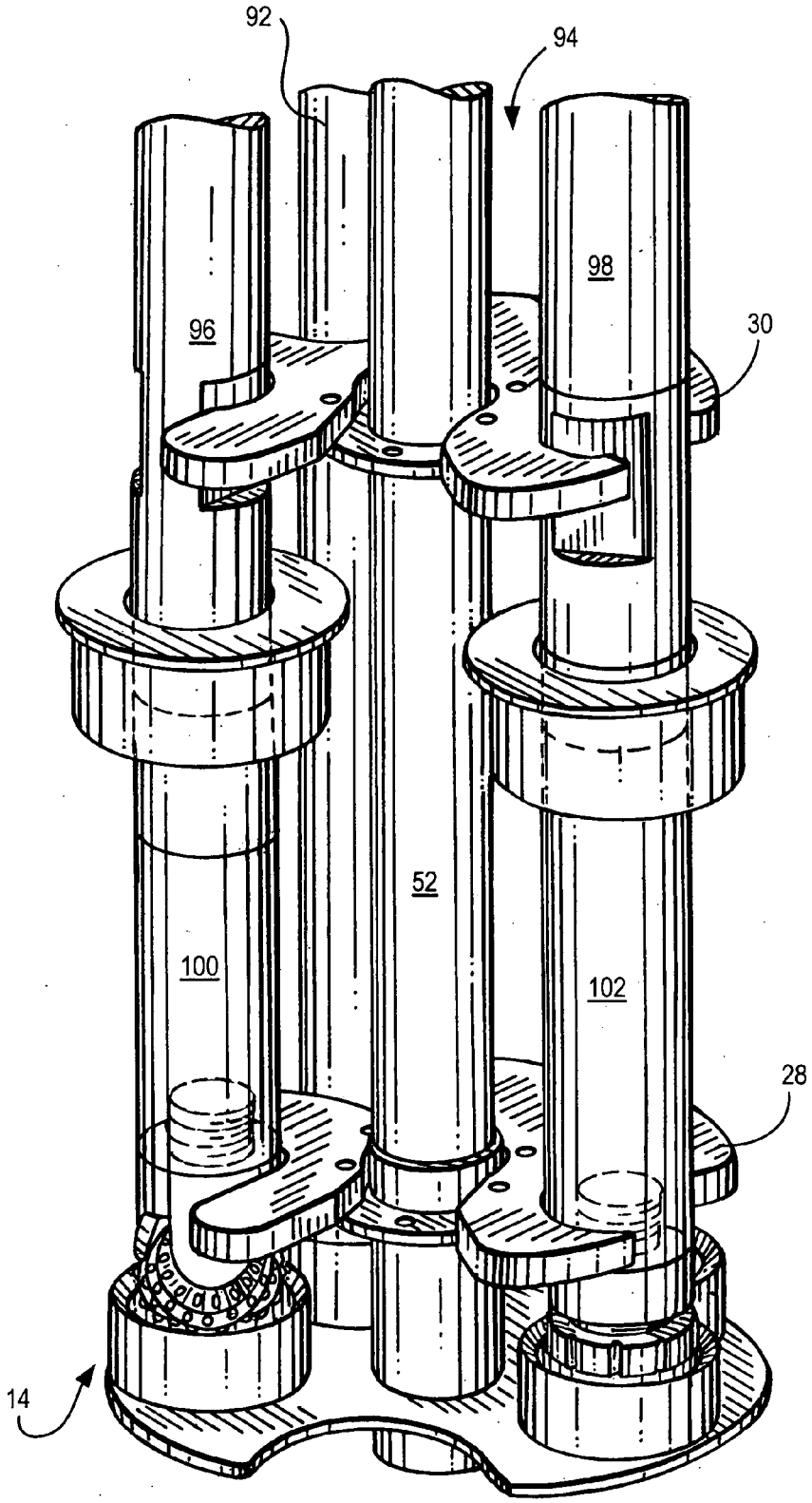
FIG. 32 is a diagrammatic top perspective view of the lower portion of the carousel, with an assortment of drill extenders and combination drill extenders with drill tools stored in position on the carousel, and within the carousel pods, the front left drill shown being a tricone drill tool and the front right drill shown being a hammer drill tool.

FIG. 32 is a diagrammatic top perspective view of the lower portion of the carousel 14, with a combination of drill extenders 92, 94 and combined drill extenders with drill tools 96, 98 stored in position on the carousel, and within the carousel pods, the front left drill tool 100 shown being a tricone drill tool and the front right drill tool 102 shown being a hammer drill tool.

The invention claimed is:

1. Apparatus for carousel drilling which comprises:

a. a drill tower including a rotatable drive motor;

b. a carousel pivotably attached with respect to said drill tower and capable of supporting a plurality of elongated drilling devices, at least certain of said drilling devices being drill extenders capable of attachment to, and detachment from, a drilling tool;

c. means for supporting the position of each said elongated drilling devices located at the upper end portion of said carousel, to retain said drilling devices in a generally vertical orientation when said drill tower and said carousel are raised to a generally vertical orientation for operative drilling;

d. first means on said carousel for individually engaging at least certain of said drilling devices at the lower end portion thereof in a manner to prevent rotation of said drilling devices for purposes of attachment to, or detachment from, other such drilling devices; and e. second means on said carousel for individually engaging at least the remaining drilling devices and preventing rotation of each said remaining drilling devices at a location above the drilling device engagement location of said first engaging means, said second engaging means being located above said first engaging means wherein said carousel is pivotably attached to said drill tower, and said means for supporting the position of each said drill extender at the upper end portion thereof is a retainer plate having a plurality of generally circular cutout openings for individual reception of each said drill extender;

wherein said first means for individually engaging at least two of said drilling devices at the lower end portion of said carousel is a primary breaker plate having at least two generally circular cutout openings for nestled reception of drilling devices, and at least two wrench-like cutout openings having opposed straight sides for engagement with corresponding flat surfaces on at least two of said drilling devices to restrain said drilling devices from rotation when being attached to, or detached from, said rotating drive motor or other such drilling devices; and wherein said second means for individually engaging each said drilling device is a secondary breaker plate having at least two generally circular cutout openings at locations corresponding to said cutout openings of said primary breaker plate having opposed flat surfaces, and at least two wrench-like cutout openings having opposed straight sides in positions corresponding respectively to the positions of said generally circular openings in said primary breaker plate, such that when a drilling device is positioned in one of said generally circular openings of one of said primary and said secondary breaker plates, said drilling device is also positioned in a flat sided cutout opening of said other breaker plate.

2. The apparatus according to claim 1, wherein at least two of said elongated drilling devices are standard sized drill extenders.

3. The apparatus according to claim 2, wherein at least one of said elongated drilling devices is a standard size drill extender having a hammer drill tool attached at the lower end thereof.

4. The apparatus according to claim 3, wherein at least one of said drilling devices is a standard size drill extender having a tricone drill tool attached at the lower end thereof.

5. Apparatus for carousel drilling which comprises:

a. a drill tower including a rotatable drive motor;

b. a carousel pivotably attached with respect to said drill tower and capable of supporting a plurality of elongated drilling devices, at least two of said drilling devices being drill extenders capable of attachment to, and detachment from, a drilling tool, and at least two of said drilling devices comprised of drill extenders having a drill tool attached to the lower end thereof, each of said drilling devices being substantially equal in length;

c. an upper retainer plate mounted on said carousel for supporting the position of each said elongated drilling devices located at the upper end portion of said carousel, said retainer plate including four generally circular cutout openings for nestled reception of each said drilling device, to retain said drilling devices in a generally vertical orientation when said drill tower and said carousel are raised to a generally vertical orientation for operative drilling;

d. a primary breaker plate having at least two cutout openings for receiving and engaging two of said drilling devices at the lower end portion thereof in a manner to prevent rotation of said drilling devices for purposes of attachment to, or detachment from, other such drilling devices; and e. a secondary breaker plate having at least two cutout openings for receiving and engaging the remaining two of said drilling devices and located above said first drilling device engaging means, said secondary breaker plate being capable of individually engaging and preventing rotation of each of the remaining two of said drilling device at a location above the engagement location of said first engaging means.

6. The apparatus according to claim 5, wherein at least two of said elongated drilling devices are standard sized drill extenders.

7. The apparatus according to claim 6, wherein at least one of said elongated drilling devices is a standard size drill extender having a hammer drill tool attached at the lower end thereof.

8. The apparatus according to claim 7, wherein at least one of said drilling devices is a standard size drill extender having a tricone drill tool attached at the lower end thereof.

9. The apparatus according to claim 8, wherein said carousel is pivotably attached to said drill tower, and said upper retainer plate has a plurality of generally circular cutout openings for individual reception of each said drill extender.

10. The apparatus according to claim 5, wherein said primary breaker plate has at least two generally circular openings and at least two wrench-like cutout openings having opposed straight sides for reception of, and engagement with, corresponding flat surfaces on at least two of said drilling devices to restrain said drilling devices from rotation when being attached to, or detached from, said rotary drive motor or other such drilling devices.

11. The apparatus according to claim 10, wherein said secondary breaker plate has at least two generally circular cutout openings at locations corresponding to said cutout openings of said primary breaker plate having opposed flat surfaces, and at least two wrench-like cut openings having opposed straight sides in positions corresponding respectively to the positions of said generally circular openings in said primary breaker plate, such that when a drilling device is positioned in one of said generally circular openings of one of said primary and said secondary breaker plates respectively, said drilling device is also positioned in a flat sided cutout opening of said other breaker plate.

12. The apparatus according to claim 11 wherein the two wrench-like cutout openings on said primary breakout plate are disposed axially below the two generally circular cutout openings of said primary breaker plate.

13. Apparatus for carousel drilling which comprises:

a. a drill tower including a rotatable drive motor;

b. a carousel pivotably attached with respect to said drill tower and capable of supporting four elongated drilling devices, at least certain of said drilling devices being drill extenders capable of attachment to, and detachment from, a drilling tool;

c. an upper retainer plate attached to said carousel for supporting the position of each said elongated drilling devices located at the upper end portion of said carousel, to retain said drilling devices in a generally vertical orientation when said drill tower and said carousel are raised to a generally vertical orientation for operative drilling;

d. a primary breaker plate attached to said carousel for individually engaging two of said drilling devices at the lower end portion thereof, said primary breaker plate being configured to prevent rotation of the two of said drilling devices for purposes of attachment to, or detachment from, other such drilling devices; and e. a secondary breaker plate attached to said carousel for individually engaging the remaining two drilling devices and located above said primary drilling device engaging means, said secondary breaker plate being capable of individually engaging and preventing rotation of each said remaining two drilling devices at a location above the drilling device engagement location of said first engaging means, wherein the secondary breaker plate is not configured to prevent rotation of the two of said drilling devices while preventing rotation of the remaining two of said drilling devices.

14. The apparatus according to claim 13, wherein said primary breaker plate has at least two generally circular openings and at least two wrench-like cutout openings having opposed straight sides for reception of, and engagement with, corresponding flat surfaces on at least two of said drilling devices to restrain said drilling devices from rotation when being attached to, or detached from, said rotary drive motor or other such drilling devices; and wherein said secondary breaker plate has at least two generally circular cutout openings at locations corresponding to said cutout openings of said primary breaker plate having opposed flat surfaces, and at least two wrench-like cut openings having opposed straight sides in positions corresponding respectively to the positions of said generally circular openings in said primary breaker plate, such that when a drilling device is positioned in one of said generally circular openings of one of said primary and said secondary breaker plates respectively, said drilling device is also positioned in a flat sided cutout opening of said other breaker plate.

15. The apparatus according to claim 14 wherein the two wrench-like cutout openings on said primary breakout plate are disposed axially below the two generally circular cutout openings of said primary breaker plate, wherein the primary breaker plate is not configured to prevent rotation of the remaining two drilling devices while preventing rotation of the two of said drilling devices.

16. The apparatus according to claim 14 wherein the generally circular openings and the wrench-like cutout openings of said primary breaker plate are in the same plane in said primary breaker plate.

17. The apparatus according to claim 14 wherein the generally circular openings and the wrench-like cutout openings of said secondary breaker plate are in the same plane in said secondary breaker plate.

* * * * *